US009631468B2

(12) United States Patent
Miller

(10) Patent No.: US 9,631,468 B2
(45) Date of Patent: Apr. 25, 2017

(54) WELL TREATMENT

(71) Applicant: Schlumberger Technology Corporation, Sugar Land, TX (US)

(72) Inventor: Matthew J. Miller, Katy, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 154 days.

(21) Appl. No.: 14/016,571

(22) Filed: Sep. 3, 2013

(65) Prior Publication Data

US 2015/0060063 A1 Mar. 5, 2015

(51) Int. Cl.

| | |
|---|---|
| ***E21B 43/267*** | (2006.01) |
| ***E21B 33/13*** | (2006.01) |
| ***E21B 43/26*** | (2006.01) |
| ***E21B 34/14*** | (2006.01) |

(52) U.S. Cl.

CPC ..... *E21B 43/26* (2013.01); *E21B 34/14* (2013.01); *E21B 33/13* (2013.01); *E21B 43/267* (2013.01)

(58) Field of Classification Search

CPC ..... E21B 43/267; E21B 43/26; E21B 43/114; E21B 43/25; E21B 43/025; E21B 43/261; E21B 43/11; C09K 8/80; C09K 8/68; C09K 2208/26; C09K 8/805

See application file for complete search history.

(56) References Cited

U.S. PATENT DOCUMENTS

| | | | |
|---|---|---|---|
| 2,223,442 | A | 12/1940 | Crowell |
| 2,374,169 | A | 4/1945 | Martin |
| 2,429,912 | A | 10/1947 | Baker |
| 2,458,278 | A | 1/1949 | Larkin et al. |
| 2,716,454 | A | 8/1955 | Abendroth |
| 3,011,548 | A | 12/1961 | Holt |
| 3,054,415 | A | 9/1962 | Baker et al. |
| 3,263,752 | A | 8/1966 | Conrad |
| 3,269,463 | A | 8/1966 | Page, Jr. |
| 3,270,814 | A | 9/1966 | Richardson et al. |
| 3,306,361 | A | 2/1967 | Lebourg |
| 3,333,635 | A | 8/1967 | Crawford |
| 3,542,127 | A | 11/1970 | Malone |
| 3,741,300 | A | 6/1973 | Wolff |

(Continued)

FOREIGN PATENT DOCUMENTS

| | | | |
|---|---|---|---|
| GB | 2375558 | A | 11/2002 |
| GB | 2386624 | A | 9/2003 |

(Continued)

OTHER PUBLICATIONS

Thomson, D. W., and Nazroo, M. F., "Design and Installation of a Cost-Effective Completion System for Horizontal Chalk Wells Where Multiple Zones Require Acid Stimulation," (a revision of SPE 39150), first presented at the Offshore Technology Conference, Houston, TX, USA, May 5-8, 1997, SPE 51177, pp. 151-156, Offshore Technology Conference.

(Continued)

*Primary Examiner* — Zakiya W Bates

(74) *Attorney, Agent, or Firm* — Andrea E. Tran

(57) ABSTRACT

In situ channelization treatment fluids are used in a multi-stage well treatment. Also, methods, fluids, equipment and/or systems relating to in situ channelization treatment fluids are used for treating a subterranean formation penetrated by a wellbore.

18 Claims, 9 Drawing Sheets

(56) References Cited

U.S. PATENT DOCUMENTS 3,995,692 A 12/1976 Seitz
4,064,937 A 12/1977 Barrington
4,099,563 A 7/1978 Hutchison et al.
4,355,686 A 10/1982 Arendt
4,429,747 A 2/1984 Williamson, Jr.
4,444,266 A 4/1984 Pringle
4,520,870 A 6/1985 Pringle
4,709,760 A 12/1987 Crist et al.
4,729,432 A 3/1988 Helms
4,771,831 A 9/1988 Pringle et al.
4,813,481 A 3/1989 Sproul et al.
4,880,059 A 11/1989 Brandell et al.
4,944,348 A 7/1990 Whiteley et al.
4,949,788 A 8/1990 Szarka et al.
4,967,841 A 11/1990 Murray
5,029,644 A 7/1991 Szarka et al.
5,048,611 A 9/1991 Cochran
5,183,114 A 2/1993 Mashaw, Jr. et al.
5,224,044 A 6/1993 Tamura et al.
5,224,556 A 7/1993 Wilson et al.
5,242,022 A 9/1993 Burton et al.
5,295,393 A 3/1994 Thiercelin
5,333,692 A 8/1994 Baugh et al.
5,337,808 A 8/1994 Graham
5,361,856 A 11/1994 Surjaatmadja et al.
5,368,098 A 11/1994 Blizzard, Jr. et al.
5,375,661 A 12/1994 Daneshy et al.
5,381,862 A 1/1995 Szarka et al.
5,394,941 A 3/1995 Venditto et al.
5,425,418 A 6/1995 Arizmendi et al.
5,505,261 A 4/1996 Huber et al.
5,518,996 A 5/1996 Maroy et al.
5,526,884 A 6/1996 Lembcke
5,526,888 A 6/1996 Gazewood
5,579,844 A 12/1996 Rebardi et al.
5,598,890 A 2/1997 Richard et al.
5,609,204 A 3/1997 Rebardi et al.
5,660,232 A 8/1997 Reinhardt
5,692,564 A 12/1997 Brooks
5,765,642 A 6/1998 Surjaatmadja
5,848,646 A 12/1998 Huber et al.
5,887,657 A 3/1999 Bussear et al.
5,905,468 A 5/1999 Ikawa et al.
5,921,318 A 7/1999 Ross
5,988,285 A 11/1999 Tucker et al.
6,006,838 A 12/1999 Whiteley et al.
6,009,947 A 1/2000 Wilson et al.
6,059,032 A 5/2000 Jones
6,109,372 A 8/2000 Dorel et al.
6,112,809 A 9/2000 Angle
6,145,378 A 11/2000 McRobbie et al.
6,155,342 A 12/2000 Oneal et al.
6,186,227 B1 2/2001 Vaynshteyn et al.
6,186,230 B1 2/2001 Nierode
6,206,095 B1 3/2001 Baugh
6,216,785 B1 4/2001 Achee, Jr. et al.
6,220,357 B1 4/2001 Carmichael et al.
6,253,861 B1 7/2001 Carmichael et al.
6,286,599 B1 9/2001 Surjaatmadja et al.
6,302,199 B1 10/2001 Hawkins et al.
6,302,208 B1 10/2001 Walker et al.
6,333,699 B1 12/2001 Zierolf
6,333,700 B1 12/2001 Thomeer et al.
6,334,486 B1 1/2002 Carmody et al.
6,371,208 B1 4/2002 Norman et al.
6,371,221 B1 4/2002 Harrigan et al.
6,378,627 B1 4/2002 Tubel et al.
6,386,109 B1 5/2002 Brooks et al.
6,394,184 B2 5/2002 Tolman et al.
6,431,270 B1 8/2002 Angle
6,443,228 B1 9/2002 Aronstam et al.
6,446,729 B1 9/2002 Bixenman et al.
6,474,419 B2 11/2002 Gary et al.
6,520,255 B2 2/2003 Tolman et al.
6,520,258 B1 2/2003 Yang et al.
6,536,524 B1 3/2003 Snider
6,543,538 B2 4/2003 Tolman et al.
6,575,247 B2 6/2003 Tolman et al.
6,599,863 B1 7/2003 Palmer et al.
6,634,429 B2 10/2003 Henderson et al.
6,644,412 B2 11/2003 Bode et al.
6,655,461 B2 12/2003 Eslinger et al.
6,662,874 B2 12/2003 Surjaatmadja et al.
6,668,938 B2 12/2003 Sheffield et al.
6,672,405 B2 1/2004 Tolman et al.
6,675,891 B2 1/2004 Hailey et al.
6,719,051 B2 4/2004 Hailey et al.
6,719,054 B2 4/2004 Cheng et al.
6,725,933 B2 4/2004 Middaugh et al.
6,725,934 B2 4/2004 Coronado et al.
6,729,416 B2 5/2004 Contreras et al.
6,732,803 B2 5/2004 Garcia et al.
6,759,968 B2 7/2004 Zierolf
6,761,219 B2 7/2004 Snider et al.
6,776,235 B1 * 8/2004 England ..... 166/271
6,782,948 B2 8/2004 Echols et al.
6,808,020 B2 10/2004 Garcia et al.
6,820,694 B2 11/2004 Willberg et al.
6,843,317 B2 1/2005 Mackenzie
6,845,819 B2 1/2005 Barrett et al.
6,866,100 B2 3/2005 Gudmestad et al.
6,880,402 B1 4/2005 Couet et al.
6,880,638 B2 4/2005 Haughom et al.
6,886,406 B1 5/2005 Couet et al.
6,907,936 B2 6/2005 Fehr et al.
6,951,331 B2 10/2005 Haughom et al.
6,953,094 B2 10/2005 Ross et al.
6,962,215 B2 11/2005 Curtis et al.
6,994,170 B2 2/2006 Echols
6,997,263 B2 2/2006 Campbell et al.
7,059,407 B2 * 6/2006 Tolman et al. ..... 166/281
7,066,264 B2 6/2006 Bissonnette et al.
7,066,265 B2 6/2006 Surjaatmadja
7,093,664 B2 8/2006 Todd et al.
7,096,945 B2 8/2006 Richards et al.
7,108,065 B2 9/2006 Bertoja et al.
7,108,067 B2 9/2006 Themig et al.
7,124,831 B2 10/2006 Turley et al.
7,128,152 B2 10/2006 Anyan et al.
7,128,160 B2 10/2006 Anyan et al.
7,134,505 B2 11/2006 Fehr et al.
7,150,318 B2 12/2006 Freeman
7,165,621 B2 1/2007 Ayoub et al.
7,168,494 B2 1/2007 Starr et al.
7,191,833 B2 3/2007 Richards
7,210,533 B2 5/2007 Starr et a
7,228,912 B2 6/2007 Patel et al.
7,231,978 B2 6/2007 Rivas et al.
7,267,172 B2 9/2007 Hofman
7,275,596 B2 10/2007 Willberg et al.
7,322,417 B2 1/2008 Rytlewski et al.
7,325,617 B2 2/2008 Murray
7,343,975 B2 3/2008 Surjaatmadja et al.
7,353,879 B2 4/2008 Todd et al.
7,363,967 B2 4/2008 Burris, II et al.
7,377,321 B2 5/2008 Rytlewski
7,380,601 B2 6/2008 Willberg et al.
7,385,523 B2 6/2008 Thomeer et al.
7,387,165 B2 6/2008 Lopez de Cardenas et al.
7,431,090 B2 10/2008 Surjaatmadja et al.
7,431,091 B2 10/2008 Themig et al.
7,464,764 B2 12/2008 Xu
7,467,685 B2 12/2008 Shehab et al.
7,490,669 B2 2/2009 Walker et al.
7,520,333 B2 4/2009 Turner et al.
7,522,779 B2 4/2009 Fu et al.
7,543,634 B2 6/2009 Fehr et al.
7,543,641 B2 6/2009 Contant
7,543,647 B2 6/2009 Walker
7,571,765 B2 8/2009 Themig
7,571,766 B2 8/2009 Pauls et al.
7,575,062 B2 8/2009 East, Jr.
7,607,487 B2 10/2009 Lucas et al.
7,628,210 B2 12/2009 Avant et al.

(56) References Cited

U.S. PATENT DOCUMENTS 7,640,977 B2 1/2010 Jonas
7,661,481 B2 2/2010 Todd et al.
7,665,522 B2 2/2010 Sullivan et al.
7,665,535 B2 2/2010 Van Wulfften Palthe
7,703,507 B2 4/2010 Strickland
7,703,510 B2 4/2010 Xu
7,712,541 B2 5/2010 Loretz et al.
7,735,559 B2 6/2010 Malone
7,748,460 B2 7/2010 Themig et al.
7,784,541 B2 8/2010 Hartman et al.
7,784,543 B2 8/2010 Johnson
7,789,146 B2 9/2010 Panga et al.
7,798,224 B2 9/2010 Huang et al.
7,814,981 B2 10/2010 Marcu
7,823,637 B2 11/2010 Corbett et al.
7,832,472 B2 11/2010 Themig
7,832,488 B2 11/2010 Guerrero et al.
7,833,950 B2 11/2010 Willberg et al.
7,849,925 B2 12/2010 Patel
7,866,396 B2 1/2011 Rytlewski
7,891,774 B2 2/2011 Silverbrook
7,896,088 B2 3/2011 Guerrero et al.
7,909,108 B2 3/2011 Swor et al.
7,931,089 B2 4/2011 Miller et al.
8,008,234 B2 8/2011 Panga et al.
8,042,614 B2 10/2011 Sullivan et al.
8,066,069 B2 11/2011 Giroux et al.
8,091,641 B2 1/2012 Gambier et al.
8,104,539 B2 1/2012 Stanojcic et al.
8,119,574 B2 2/2012 Panga et al.
8,127,654 B2 3/2012 Williams et al.
8,191,629 B2 6/2012 Gordon et al.
8,201,631 B2 6/2012 Stromquist et al.
8,210,249 B2 7/2012 Panga et al.
8,215,411 B2 7/2012 Flores et al.
8,220,543 B2 7/2012 Clark et al.
8,227,026 B2 7/2012 McDaniel et al.
8,230,925 B2 7/2012 Willberg et al.
8,234,072 B2 7/2012 Smith, Jr. et al.
8,245,782 B2 8/2012 Sanchez
8,272,443 B2 9/2012 Watson et al.
8,282,365 B2 10/2012 Obrejanu
8,307,902 B2 11/2012 Telfer
8,312,921 B2 11/2012 Gambier et al.
8,372,787 B2 2/2013 Droger
8,453,734 B2 6/2013 Jasek et al.
8,474,523 B2 7/2013 Rayssiguier et al.
8,479,818 B2 7/2013 Rayssiguier et al.
8,490,707 B2 7/2013 Robisson et al.
8,511,380 B2 8/2013 Guignard et al.
2001/0045290 A1 11/2001 Pringle
2002/0049575 A1 4/2002 Jalali et al.
2002/0074128 A1 6/2002 Allamon
2002/0093431 A1 7/2002 Zierolf
2002/0157837 A1 10/2002 Bode et al.
2002/0158120 A1 10/2002 Zierolf
2002/0166665 A1 11/2002 Vincent et al.
2003/0070809 A1 4/2003 Schultz et al.
2003/0070811 A1 4/2003 Robison et al.
2003/0090390 A1 5/2003 Snider et al.
2003/0111224 A1 6/2003 Hailey et al.
2003/0136562 A1 7/2003 Robison et al.
2003/0180094 A1 9/2003 Madison
2003/0234104 A1 12/2003 Johnston et al.
2004/0040707 A1 3/2004 Dusterhoft et al.
2004/0050551 A1 3/2004 Jones
2004/0055749 A1 3/2004 Lonnes et al.
2004/0084189 A1 5/2004 Hosie et al.
2004/0092404 A1 5/2004 Murray et al.
2004/0118564 A1 6/2004 Themig et al.
2004/0231840 A1 11/2004 Ratanasirigulchai et al.
2004/0238168 A1 12/2004 Echols
2004/0262016 A1 12/2004 Farquhar
2005/0199401 A1 9/2005 Patel et al.
2005/0230118 A1 10/2005 Noske et al.
2005/0279510 A1 12/2005 Patel et al.
2006/0076133 A1 4/2006 Penno
2006/0086497 A1 4/2006 Ohmer et al.
2006/0090893 A1 5/2006 Sheffield
2006/0124310 A1 6/2006 Lopez de Cardenas et al.
2006/0124315 A1 6/2006 Frazier et al.
2006/0144590 A1 7/2006 Lopez de Cardenas et al.
2006/0157255 A1 7/2006 Smith
2006/0207764 A1 9/2006 Rytlewski
2006/0207765 A1 9/2006 Hofman
2006/0243455 A1 11/2006 Telfer et al.
2007/0044958 A1 3/2007 Rytlewski et al.
2007/0107908 A1 5/2007 Vaidya et al.
2007/0144746 A1 6/2007 Jonas
2007/0181224 A1 8/2007 Marya et al.
2007/0227731 A1 10/2007 Contant
2007/0272411 A1 11/2007 Lopez de Cardenas
2007/0272413 A1 11/2007 Rytlewski et al.
2007/0284097 A1 12/2007 Swor et al.
2008/0000697 A1 1/2008 Rytlewski
2008/0099209 A1 5/2008 Loretz et al.
2008/0105438 A1 5/2008 Jordan et al.
2008/0164027 A1 7/2008 Sanchez
2008/0196896 A1 8/2008 Bustos et al.
2008/0210429 A1 9/2008 McMillin et al.
2008/0264636 A1 10/2008 Stromquist et al.
2009/0025934 A1 1/2009 Hartman et al.
2009/0056951 A1 3/2009 Mosher et al.
2009/0065194 A1 3/2009 Frazier
2009/0084553 A1 4/2009 Rytlewski et al.
2009/0114392 A1 5/2009 Tolman et al.
2009/0139726 A1 6/2009 Gomez
2009/0158674 A1 6/2009 Guerrero et al.
2009/0242206 A1 10/2009 Goughnour et al.
2009/0260814 A1* 10/2009 Malone ..... 166/276
2009/0260835 A1 10/2009 Malone
2009/0294137 A1 12/2009 Meijer
2010/0006193 A1 1/2010 Kneisl
2010/0024327 A1 2/2010 Kennedy
2010/0044041 A1 2/2010 Smith et al.
2010/0101803 A1 4/2010 Clayton et al.
2010/0101807 A1 4/2010 Greenlee et al.
2010/0132954 A1 6/2010 Telfer
2010/0139930 A1 6/2010 Patel et al.
2010/0163238 A1 7/2010 Zhan et al.
2010/0209288 A1 8/2010 Marya
2010/0300688 A1 12/2010 Panga et al.
2010/0307737 A1 12/2010 Mellemstrand et al.
2010/0319520 A1 12/2010 Williams et al.
2011/0056692 A1 3/2011 Lopez de Cardenas et al.
2011/0061875 A1 3/2011 Tips et al.
2011/0067890 A1 3/2011 Themig
2011/0098202 A1 4/2011 James et al.
2011/0114313 A1* 5/2011 Lesko et al. ..... 166/280.1
2011/0127047 A1 6/2011 Themig et al.
2011/0174493 A1 7/2011 Clem
2011/0186298 A1 8/2011 Clark et al.
2011/0198082 A1 8/2011 Stromquist et al.
2011/0240290 A1 10/2011 Jasek et al.
2011/0240293 A1 10/2011 Lesko et al.
2011/0240301 A1 10/2011 Robison
2011/0240311 A1 10/2011 Robison
2011/0278010 A1 11/2011 Fehr et al.
2011/0284240 A1 11/2011 Chen et al.
2012/0000641 A1 1/2012 Panga et al.
2012/0048559 A1 3/2012 Ganguly et al.
2012/0067595 A1 3/2012 Noske et al.
2012/0085538 A1 4/2012 Guerrero et al.
2012/0085548 A1 4/2012 Fleckenstein et al.
2012/0090847 A1 4/2012 Getzlaf et al.
2012/0097398 A1 4/2012 Ravensbergen et al.
2012/0111563 A1 5/2012 Abad et al.
2012/0132421 A1 5/2012 Loiseau et al.
2012/0138296 A1 6/2012 Panga et al.
2012/0152550 A1 6/2012 East, Jr.
2012/0168152 A1 7/2012 Casciaro
2012/0175134 A1 7/2012 Robisson et al.
2012/0292032 A1 11/2012 Themig et al.
2012/0305245 A1 12/2012 Loiseau et al.

(56) References Cited

U.S. PATENT DOCUMENTS

| | | | |
|---|---|---|---|
| 2012/0305254 | A1 | 12/2012 | Chen et al. |
| 2012/0305265 | A1 | 12/2012 | Garcia et al. |
| 2012/0312557 | A1 | 12/2012 | King |
| 2013/0025868 | A1 | 1/2013 | Smith et al. |
| 2013/0025876 | A1 | 1/2013 | McCoy et al. |
| 2013/0062055 | A1 | 3/2013 | Tolman et al. |
| 2013/0067594 | A1 | 3/2013 | Kantor et al. |
| 2013/0075095 | A1 | 3/2013 | Rayssiguier et al. |
| 2013/0081827 | A1 | 4/2013 | Etzel |
| 2013/0092400 | A1 | 4/2013 | Stewart et al. |
| 2013/0112435 | A1 | 5/2013 | Fleming et al. |
| 2013/0112436 | A1 | 5/2013 | Fleming et al. |
| 2013/0146293 | A1 | 6/2013 | Zazovsky et al. |
| 2013/0161017 | A1 | 6/2013 | King |
| 2013/0168090 | A1 | 7/2013 | Themig et al. |
| 2013/0175040 | A1 | 7/2013 | Madero et al. |
| 2013/0186644 | A1 | 7/2013 | Smith et al. |
| 2013/0206402 | A1 | 8/2013 | Coon |
| 2013/0220603 | A1 | 8/2013 | Robison et al. |
| 2013/0233542 | A1 | 9/2013 | Shampine et al. |
| 2013/0233564 | A1 | 9/2013 | Pacey |
| 2013/0255963 | A1 | 10/2013 | Guerrero et al. |
| 2013/0312960 | A1 | 11/2013 | Jasek et al. |
| 2013/0319658 | A1 | 12/2013 | Huh et al. |
| 2013/0319669 | A1 | 12/2013 | Dupree et al. |
| 2013/0319687 | A1 | 12/2013 | Huh et al. |
| 2013/0324444 | A1 | 12/2013 | Lesko et al. |
| 2013/0333883 | A1 | 12/2013 | Ehtesham et al. |
| 2014/0262264 | A1 | 9/2014 | Potapenko et al. |

FOREIGN PATENT DOCUMENTS

| | | | |
|---|---|---|---|
| GB | 2411189 | A | 8/2005 |
| GC | 0001546 | | 10/2011 |
| WO | 2000063520 | A1 | 10/2000 |
| WO | 0107860 | A2 | 2/2001 |
| WO | 0142620 | A1 | 6/2001 |
| WO | 0173423 | A1 | 10/2001 |
| WO | 0192687 | A2 | 12/2001 |
| WO | 03095794 | A1 | 11/2003 |
| WO | 2004088091 | A1 | 10/2004 |
| WO | 2008086165 | A2 | 7/2008 |
| WO | 2010059060 | A1 | 5/2010 |
| WO | 2010112810 | A2 | 10/2010 |
| WO | 2010124371 | A1 | 11/2010 |
| WO | WO2011050046 | | 4/2011 |
| WO | 2011058325 | A2 | 5/2011 |
| WO | 2011126633 | A1 | 10/2011 |
| WO | 2012030843 | A2 | 3/2012 |
| WO | 2012045165 | A1 | 4/2012 |
| WO | 2012054383 | A2 | 4/2012 |
| WO | WO2012054456 | | 4/2012 |
| WO | WO2012069541 | | 5/2012 |
| WO | 2012083047 | A2 | 6/2012 |
| WO | WO2012082302 | | 6/2012 |
| WO | 2012091926 | A2 | 7/2012 |
| WO | 2012107730 | A2 | 8/2012 |
| WO | WO2012154932 | | 11/2012 |
| WO | 2013028385 | A2 | 2/2013 |
| WO | 2013028801 | A1 | 2/2013 |
| WO | 2013048810 | A1 | 4/2013 |
| WO | 2013053057 | A1 | 4/2013 |
| WO | 2013055516 | A1 | 4/2013 |
| WO | 2013070446 | A1 | 5/2013 |
| WO | 2013074593 | A1 | 5/2013 |
| WO | WO2013085412 | | 6/2013 |
| WO | 2013106259 | A1 | 7/2013 |
| WO | 2013150304 | A2 | 10/2013 |
| WO | 2013184301 | A1 | 12/2013 |
| WO | 2013184302 | A1 | 12/2013 |

OTHER PUBLICATIONS

Lonnes, et al., "Advanced Multizone Stimulation Technology," presented at the 2005 SPE Annual Technical Conference and Exhibition, Dallas, TX, USA, Oct. 9-12, 2005, SPE 95778, 7 pages, Society of Petroleum Engineers.

Rytlewski, G., "Multiple-Layer Completions for Efficient Treatment of Multilayer Reservoirs," Presented at the 2008 IADC/SPE Drilling Conference, Orlando, FL, USA, Mar. 4-6, 2008, IADC/SPE 112476, 8 pages, IADC/SPE Drilling Conference.

The unpublished specification and drawings of U.S. Appl. No. 13/832,938 as filed, Specification is 30 pages total and drawings are 8 pages total, 2013.

Potapenko, et al.,"Barnett Shale Refracture Stimulations Using a Novel Diversion Technique," presented at the 2009 SPE Hydraulic Fracturing Technology Conference, The Woodlands, Texas, USA, Jan. 19-21, 2009, SPE 119636, 11 pages, Society of Petroleum Engineers.

Taylor, "The Dispersion of Matter in Turbulent Flow through a Pipe," 1954, Proceedings of the Royal Society of London, pp. 446-468, vol. 223, The Royal Society.

Taylor, "Dispersion of Soluble Matter in Solvent Flowing Slowly Through a Tube," Aug. 25, 1953, Proceedings of the Royal Society of London. Series A, Mathematical and Physical Sciences, pp. 186-203, vol. 219, No. 1137.

Angeles, et al., "First Application of Just-in-Time Perforating in a Horizontal Well", SPE-152100—SPE Hydraulic Fracturing Technology Conference, The Woodlands, Texas, USA, Feb. 6-8, 2012, 13 pages.

King, "Optimize multizone fracturing", BJ Services Co., E&P magazine, Aug. 29, 2007; 3 pages.

International Search Report and Written Opinion issued in PCT/US2014/051170 on Nov. 24, 2014, 16 pages.

McDaniel, "Review of Current Fracture Stimulation Techniques for Best Economics in Multi-layer, Lower Permeability Reservoirs", SPE 98025—SPE Eastern Regional Meeting, Sep. 14-16, Morgantown, West Virginia, Sep. 2005, 19 pages.

International Search Report issued in related International Application No. PCT/US2012/062098 mailed Mar. 4, 2013 (3 pages).

International Search Report and Written Opinion issued in related International Application No. PCT/US2012/062085 mailed Mar. 14, 2013 (10 pages).

International Search Report and Written Opinion issued in related International Application No. PCT/US2014/051294 mailed Mar. 14, 2013 (19 pages).

* cited by examiner

WELL TREATMENT

RELATED APPLICATION DATA

None.

BACKGROUND

The statements in this section merely provide background information related to the present disclosure and may not constitute prior art.

In wells employing multistage hydraulic fracturing stage tools, a fracturing port is usually opened by sliding a sleeve, permitting injected fracturing fluids to escape the wellbore and create a fracture in the surrounding formation. The device that shifts the sleeve is a ball, a dart, or even a length of tubing inserted into the wellbore. The device travels (or is inserted) up to the point where the device is captured by a capture feature on the stage tool, such as a collet, lever, cavity, etc., and further device motion pushes the sleeve open. Some representative multistage hydraulic fracturing stage tools are disclosed in U.S. Pat. No. 7,387,165, U.S. Pat. No. 7,322,417, U.S. Pat. No. 7,377,321, US20070107908, US20070044958, US20100209288, U.S. Pat. No. 7,387,165, US2009/0084553, U.S. Pat. No. 7,108,067, U.S. Pat. No. 7,431,091, U.S. Pat. No. 6,907,936, U.S. Pat. No. 7,543,634, U.S. Pat. No. 7,134,505, U.S. Pat. No. 7,021,384, U.S. Pat. No. 7,353,878, U.S. Pat. No. 7,267,172, U.S. Pat. No. 7,681,645, U.S. Pat. No. 7,703,510, U.S. Pat. No. 7,784,543, U.S. Pat. No. 7,628,210, WO2012083047, U.S. Pat. No. 7,066,265, U.S. Pat. No. 7,168,494, U.S. Pat. No. 7,353,879, U.S. Pat. No. 7,093,664, U.S. Pat. No. 7,210,533, U.S. Pat. No. 7,343,975, U.S. Pat. No. 7,431,090, U.S. Pat. No. 7,571,766, U.S. Pat. No. 8,104,539, and US2010/0044041, U.S. Pat. No. 8,066,069, U.S. Pat. No. 6,866,100, U.S. Pat. No. 8,201,631; US20120090847; US20110198082; US20080264636, which are hereby incorporated herein by reference.

Fracturing is used to increase permeability of subterranean formations. A fracturing fluid is injected into the wellbore passing through the subterranean formation. A propping agent (proppant) is injected into the fracture to prevent fracture closing and, thereby, to provide improved extraction of extractive fluids, such as oil, gas or water.

The proppant maintains the distance between the fracture walls in order to create conductive channels in the formation. It is know that heterogeneous placement through pulsing of proppant enable to create pillars improving the conductivity of the fracture and thus enabling a higher productivity of the wells; however, such a process is generally difficult to control when involving multistage completion tools.

Such multistage tool enable a reduction of non-productive time and thus the industry would welcome a system enabling the formation of pillars and/or cluster when using multistage completion tools.

SUMMARY

In some embodiments herein, the treatments, treatment fluids, systems, equipment, methods, and the like employ, an in situ method and system for increasing fracture conductivity. In embodiments, a treatment slurry stage has a solid particulates concentration and a concentration of an additive that facilitates clustering of the solid particulates in the fracture, anchoring of the clusters in the fracture, or a combination thereof, to form anchored clusters of the solid particulates to prop open the fracture upon closure and provide hydraulic conductivity through the fracture following closure, such as, for example, by forming interconnected, hydraulically conductive channels between the clusters.

In embodiments, a method for treating a subterranean formation penetrated by a wellbore comprises: injecting an in situ channelization treatment stage fluid above a fracturing pressure to form a fracture in the formation; distributing solid particulates into the formation in the treatment stage fluid; aggregating the first solid particulate distributed into the fracture to form spaced-apart clusters in the fracture; anchoring the clusters in the fracture to inhibit aggregation of the clusters; reducing pressure in the fracture to prop the fracture open on the clusters and form interconnected, hydraulically conductive channels between the clusters.

In some embodiments, a method for treating a subterranean formation penetrated by a wellbore comprises: injecting into a fracture in the formation at a continuous rate an in situ channelization treatment fluid stage with solid particulates concentration; while maintaining the continuous rate and first solid particle concentration during injection of the treatment fluid stage, successively alternating concentration modes of an anchorant in the treatment fluid stage between a plurality of relatively anchorant-rich modes and a plurality of anchorant-lean modes within the injected treatment fluid stage.

In some embodiments, a method for treating a subterranean formation penetrated by a wellbore comprises: injecting into a fracture in the formation an in situ channelization treatment fluid stage comprising a viscosified carrier fluid with solid particulates to form a homogenous region within the fracture of uniform distribution of the solid particulates; and anchors in the treatment fluid; reducing the viscosity of the carrier fluid within the homogenous region to induce settling of the solid particulates prior to closure of the fracture to form hydraulically conductive channels with anchor-lean areas and pillars in anchorant-rich areas; and thereafter allowing the fracture to close onto the pillars. In some embodiments, hydraulically conductive channels may also be formed in or through the anchorant-rich areas and/or the pillars, e.g., as disclosed in copending commonly assigned U.S. patent application Ser. No. 13/832,938, which is hereby incorporated herein by reference in its entirety.

In some embodiments, a system to produce reservoir fluids comprises the wellbore and fracture resulting from any of the fracturing methods disclosed herein.

In some embodiments, a system to treat a subterranean formation penetrated by a wellbore comprises: a pump system to deliver an in situ channelization treatment stage fluid through the wellbore to the formation above a fracturing pressure to form a fracture in the formation; a treatment stage fluid supply unit to distribute solid particulates into the treatment stage fluid, and to introduce an anchorant into the treatment stage fluid; a trigger in the treatment stage fluid to initiate aggregation of the first solid particulate in the fracture to form spaced-apart clusters in the fracture; an anchoring system in the treatment fluid stage to anchor the clusters in the fracture and inhibit settling or aggregation of the clusters; and a shut-in system to maintain and then reduce pressure in the fracture to prop the fracture open on the clusters and form interconnected, hydraulically conductive channels between the clusters.

In embodiments, a system to treat a subterranean formation penetrated by a wellbore comprises: means for injecting an in situ channelization treatment stage fluid above a fracturing pressure to form a fracture in the formation;

means for distributing solid particulates into the formation in the treatment stage fluid; means for aggregating the solid particulate distributed into the fracture to form spaced-apart clusters in the fracture; means for anchoring the clusters in the fracture to inhibit settling or aggregation of the clusters; means for reducing pressure in the fracture to prop the fracture open on the clusters and form interconnected, hydraulically conductive channels between the clusters.

In some embodiments, a method comprises: placing a downhole completion staging system or tool in a wellbore adjacent a subterranean formation; operating the downhole completion staging system tool to establish one or more passages for fluid communication between the wellbore and the subterranean formation in a plurality of wellbore stages spaced along the wellbore; isolating one of the wellbore stages for treatment; injecting a treatment slurry having a solid particulates concentration and a concentration of an additive that facilitates clustering of the solid particulates in the fracture, anchoring of the clusters in the fracture, or a combination thereof, to form anchored clusters of the solid particulates to prop open the fracture upon closure and provide hydraulic conductivity through the fracture following closure, such as, for example, by forming interconnected, hydraulically conductive channels between the clusters; and repeating the isolation and pillars placement for one or more additional stages.

In some embodiments, a method comprises: placing a downhole completion staging system or tool in a wellbore adjacent a subterranean formation; operating the downhole completion staging system or tool to establish one or more passages for fluid communication between the wellbore and the subterranean formation in a plurality of wellbore stages spaced along the wellbore; isolating one of the wellbore stages for treatment; injecting an in situ channelization treatment fluid through the wellbore and the one or more passages of the isolated wellbore stage into the subterranean formation to place pillars in a fracture in the subterranean formation; circulating a treatment slurry having a solid particulates concentration and a concentration of an additive that facilitates clustering of the solid particulates in the fracture; and repeating the isolation, solid particulates and clustering additive placement circulation for one or more additional stages.

BRIEF DESCRIPTION OF THE DRAWINGS

These and other features and advantages will be better understood by reference to the following detailed description when considered in conjunction with the accompanying drawings.

DETAILED DESCRIPTION OF SOME ILLUSTRATIVE EMBODIMENTS

Figure 1A:
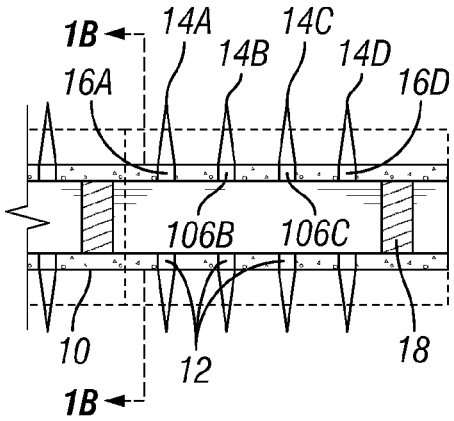
FIG. 1A shows a schematic of a horizontal well with perforation clusters according to some embodiments of the current application.

For the purposes of promoting an understanding of the principles of the disclosure, reference will now be made to some illustrative embodiments of the current application. Like reference numerals used herein refer to like parts in the various drawings. Reference numerals without suffixed letters refer to the part(s) in general; reference numerals with suffixed letters refer to a specific one of the parts.

As used herein, "embodiments" refers to non-limiting examples of the application disclosed herein, whether claimed or not, which may be employed or present alone or in any combination or permutation with one or more other embodiments. Each embodiment disclosed herein should be regarded both as an added feature to be used with one or more other embodiments, as well as a further embodiment to be used separately or in lieu of one or more other embodiments. It should be understood that no limitation of the scope of the claimed subject matter is thereby intended, any alterations and further modifications in the illustrated embodiments, and any further applications of the principles of the application as illustrated therein as would normally occur to one skilled in the art to which the disclosure relates are contemplated herein.

Moreover, the schematic illustrations and descriptions provided herein are understood to be examples only, and components and operations may be combined or divided, and added or removed, as well as re-ordered in whole or part, unless stated explicitly to the contrary herein. Certain operations illustrated may be implemented by a computer executing a computer program product on a computer readable medium, where the computer program product comprises instructions causing the computer to execute one or more of the operations, or to issue commands to other devices to execute one or more of the operations.

It should be understood that, although a substantial portion of the following detailed description may be provided in the context of oilfield hydraulic fracturing operations, other oilfield operations such as cementing, gravel packing, etc., or even non-oilfield well treatment operations, can utilize and benefit as well from the disclosure of the present treatment slurry.

In some embodiments according to the disclosure herein, an in situ method and system are provided for increasing fracture conductivity. By "in situ" is meant that channels of relatively high hydraulic conductivity are formed in a fracture after it has been filled with a generally uniform distribution of proppant particles. As used herein, a "hydraulically conductive fracture" is one which has a high conductivity relative to the adjacent formation matrix, whereas the term "conductive channel" refers to both open channels as well as channels filled with a matrix having interstitial spaces for permeation of fluids through the channel, such that the channel has a relatively higher conductivity than adjacent non-channel areas.

The term "continuous" in reference to concentration or other parameter as a function of another variable such as time, for example, means that the concentration or other parameter is an uninterrupted or unbroken function, which may include relatively smooth increases and/or decreases with time, e.g., a smooth rate or concentration of proppant particle introduction into a fracture such that the distribution of the proppant particles is free of repeated discontinuities and/or heterogeneities over the extent of proppant particle filling. In some embodiments, a relatively small step change in a function is considered to be continuous where the change is within +/−10% of the initial function value, or within +/−5% of the initial function value, or within +/−2% of the initial function value, or within +/−1% of the initial function value, or the like over a period of time of 1 minute, 10 seconds, 1 second, or 1 millisecond. The term "repeated" herein refers to an event which occurs more than once in a stage.

Conversely, a parameter as a function of another variable such as time, for example, is "discontinuous" wherever it is not continuous, and in some embodiments, a repeated relatively large step function change is considered to be discontinuous, e.g., where the lower one of the parameter values before and after the step change is less than 80%, or less than 50%, or less than 20%, or less than 10%, or less than 5%, or less than 2% or less than 1%, of the higher one of the parameter values before and after the step change over a period of time of 1 minute, 10 seconds, 1 second, or 1 millisecond.

In embodiments, the conductive channels are formed in situ after placement of the proppant particles in the fracture by differential movement of the proppant particles, e.g., by gravitational settling and/or fluid movement such as fluid flow initiated by a flowback operation, out of and/or away from an area(s) corresponding to the conductive channel(s) and into or toward spaced-apart areas in which clustering of the proppant particles results in the formation of relatively less conductive areas, which clusters may correspond to pillars between opposing fracture faces upon closure.

In some embodiments, an in situ channelization treatment slurry stage has a concentration of solid particulates, e.g., proppant, and a concentration of an additive that facilitates either clustering of the particulates in the fracture, or anchoring of the clusters in the fracture, or a combination thereof, to form anchored clusters of the solid particulates to prop open the fracture upon closure. As used herein, "anchorant" refers to a material, a precursor material, or a mechanism, that inhibits settling, or preferably stops settling, of particulates or clusters of particulates in a fracture, whereas an "anchor" refers to an anchorant that is active or activated to inhibit or stop the settling. In some embodiments, the anchorant may comprise a material, such as fibers, flocs, flakes, discs, rods, stars, etc., for example, which may be heterogeneously distributed in the fracture and have a different settling rate, and/or cause some of the first solid particulate to have a different settling rate, which may be faster or preferably slower with respect to the first solid particulate and/or clusters. As used herein, the term "flocs" includes both flocculated colloids and colloids capable of forming flocs in the treatment slurry stage.

In some embodiments, the anchorant may adhere to one or both opposing surfaces of the fracture to stop movement of a proppant particle cluster and/or to provide immobilized structures upon which proppant or proppant cluster(s) may accumulate. In some embodiments, the anchors may adhere to each other to facilitate consolidation, stability and/or strength of the formed clusters.

In some embodiments, the anchorant may comprise a continuous concentration of a first anchorant component and a discontinuous concentration of a second anchorant component, e.g., where the first and second anchorant components may react to form the anchor as in a two-reactant system, a catalyst/reactant system, a pH-sensitive reactant/pH modifier system, or the like.

In some embodiments, the anchorant may form lower boundaries for particulate settling.

In some embodiments, a method for treating a subterranean formation penetrated by a wellbore comprises: injecting a treatment stage fluid above a fracturing pressure to form a fracture in the formation; distributing particulates into the formation in the treatment stage fluid; aggregating the solid particulates distributed into the fracture to form spaced-apart clusters in the fracture; anchoring at least some of the clusters in the fracture to inhibit aggregation of at least some of the clusters; reducing pressure in the fracture to prop the fracture open on the clusters and form interconnected, hydraulically conductive channels between the clusters.

In some embodiments, the solid particulates distributed in the treatment stage fluid comprise disaggregated proppant. In some embodiments, the aggregation comprises triggering settling of the distributed solid particulates. In some embodiments, the method further comprises viscosifying the treatment stage fluid for distributing the solid particulates into the formation, and breaking the treatment stage fluid in the fracture to trigger the settling. In some embodiments, the method further comprises successively alternating concentration modes of an anchorant in the treatment stage fluid between a relatively anchorant-rich mode and an anchorant-lean mode during the continuous distribution of the solid particulate into the formation in the treatment stage fluid to facilitate one or both of the cluster aggregation and anchoring. As used herein, an anchorant is an additive either which induces or facilitates agglomeration of solid particulates into clusters, or which facilitates the activation of anchors, as defined above, or both. In some embodiments, the anchorant comprises fibers, flocs, flakes, discs, rods, stars, etc. In some embodiments, the anchorant-lean concentration mode is free or essentially free of anchorant, or a difference between the concentrations of the anchorant-rich and anchorant-lean modes is at least 10, or at least 25, or at least 40, or at least 50, or at least 60, or at least 75, or at least 80, or at least 90, or at least 95, or at least 98, or at least 99, or at least 99.5 weight percent of the anchorant concentration of the anchorant-rich mode. An anchorant-lean mode is essentially free of anchorant if the concentration of anchorant is insufficient to form anchors.

In some embodiments, the conductive channels extend in fluid communication from adjacent a face of in the formation away from the wellbore to or to near the wellbore, e.g., to facilitate the passage of fluid between the wellbore and the formation, such as in the production of reservoir fluids and/or the injection of fluids into the formation matrix. As used herein, "near the wellbore" refers to conductive channels coextensive along a majority of a length of the fracture terminating at a permeable matrix between the conductive channels and the wellbore, e.g., where the region of the fracture adjacent the wellbore is filled with a permeable solids pack as in a high conductive proppant tail-in stage, gravel packing or the like.

In some embodiments, the injection of the treatment fluid stage forms a homogenous region within the fracture of continuously uniform distribution of the first solid particulate. In some embodiments, the alternation of the concentration of the anchorant forms heterogeneous areas within the fracture comprising anchorant-rich areas and anchorant-lean areas.

In some embodiments, the injected treatment fluid stage comprises a viscosified carrier fluid, and the method may further comprise reducing the viscosity of the carrier fluid in the fracture to induce settling of the first solid particulate prior to closure of the fracture, and thereafter allowing the fracture to close.

In some embodiments, the method may also include forming bridges with the anchorant-rich modes in the fracture and forming conductive channels between the bridges with the anchorant-lean modes.

In some embodiments, a method for treating a subterranean formation penetrated by a wellbore comprises: injecting into a fracture in the formation at a treatment fluid stage comprising a viscosified carrier fluid with solid particulates and anchors to form a homogenous region within the fracture of uniform distribution; reducing the viscosity of the carrier fluid within the homogenous region to induce settling of the first solid particulate prior to closure of the fracture to form hydraulically conductive channels and pillars; and thereafter allowing the fracture to close onto the pillars.

In some embodiments, the solid particulates and the anchorant may have different characteristics to impart different settling rates. In some embodiments, the solid particulates and the anchorant may have different shapes, sizes, densities or a combination thereof. In some embodiments, the anchorant has an aspect ratio, defined as the ratio of the longest dimension of the particle to the shortest dimension of the particle, higher than 6. In some embodiments, the anchorant is a fiber, a floc, a flake, a ribbon, a platelet, a rod, or a combination thereof.

In some embodiments, the anchorant may comprise a degradable material. In some embodiments, the anchorant is selected from the group consisting of polylactic acid (PLA), polyglycolic acid (PGA), polyethylene terephthalate (PET), polyester, polyamide, polycaprolactam and polylactone, poly(butylene Succinate, polydioxanone, glass, ceramics, carbon (including carbon-based compounds), elements in metallic form, metal alloys, wool, basalt, acrylic, polyethylene, polypropylene, novoloid resin, polyphenylene sulfide, polyvinyl chloride, polyvinylidene chloride, polyurethane, polyvinyl alcohol, polybenzimidazole, polyhydroquinone-diimidazopyridine, poly(p-phenylene-2,6-benzobisoxazole), rayon, cotton, or other natural fibers, rubber, sticky fiber, or a combination thereof. In some embodiments the anchorant may comprise acrylic fiber. In some embodiments the anchorant may comprise mica.

In some embodiments, the anchorant is present in the anchorant-laden stages of the treatment slurry in an amount of less than 5 vol %. All individual values and subranges from less than 5 vol % are included and disclosed herein. For example, the amount of anchorant may be from 0.05 vol % less than 5 vol %, or less than 1 vol %, or less than 0.5 vol %. The anchorant may be present in an amount from 0.5 vol % to 1.5 vol %, or in an amount from 0.01 vol % to 0.5 vol %, or in an amount from 0.05 vol % to 0.5 vol %.

In further embodiments, the anchorant may comprise a fiber with a length from 1 to 50 mm, or more specifically from 1 to 10 mm, and a diameter of from 1 to 75 microns, or, more specifically from 1 to 50 microns. All values and subranges from 1 to 50 mm are included and disclosed herein. For example, the fiber agglomerant length may be from a lower limit of 1, 3, 5, 7, 9, 19, 29 or 49 mm to any higher upper limit of 2, 4, 6, 8, 10, 20, 30 or 50 mm. The fiber anchorant length may range from 1 to 50 mm, or from 1 to 10 mm, or from 1 to 7 mm, or from 3 to 10 mm, or from 2 to 8 mm. All values from 1 to 50 microns are included and disclosed herein. For example, the fiber anchorant diameter may be from a lower limit of 1, 4, 8, 12, 16, 20, 30, 40, or 49 microns to an upper limit of 2, 6, 10, 14, 17, 22, 32, 42, 50 or 75 microns. The fiber anchorant diameter may range from 1 to 75 microns, or from 10 to 50 microns, or from 1 to 15 microns, or from 2 to 17 microns.

In further embodiments, the anchorant may be fiber selected from the group consisting of polylactic acid (PLA), polyester, polycaprolactam, polyamide, polyglycolic acid, polyterephthalate, cellulose, wool, basalt, glass, rubber, or a combination thereof.

In further embodiments, the anchorant may comprise a fiber with a length from 0.001 to 1 mm and a diameter of from 50 nanometers (nm) to 10 microns. All individual values from 0.001 to 1 mm are disclosed and included herein. For example, the anchorant fiber length may be from a lower limit of 0.001, 0.01, 0.1 or 0.9 mm to any higher upper limit of 0.009, 0.07, 0.5 or 1 mm. All individual values from 50 nanometers to 10 microns are included and disclosed herein. For example, the fiber anchorant diameter may range from a lower limit of 50, 60, 70, 80, 90, 100, or 500 nanometers to an upper limit of 500 nanometers, 1 micron, or 10 microns.

In some embodiments, the anchorant may comprise an expandable material, such as, for example, swellable elastomers, temperature expandable particles, Examples of oil swellable elastomers include butadiene based polymers and copolymers such as styrene butadiene rubber (SBR), styrene butadiene block copolymers, styrene isoprene copolymer, acrylate elastomers, neoprene elastomers, nitrile elastomers, vinyl acetate copolymers and blends of EV A, and polyurethane elastomers. Examples of water and brine swellable elastomers include maleic acid grafted styrene butadiene elastomers and acrylic acid grafted elastomers. Examples of temperature expandable particles include metals and gas filled particles that expand more when the particles are heated relative to silica sand. In some embodiments, the expandable metals can include a metal oxide of Ca, Mn, Ni, Fe, etc. that reacts with the water to generate a metal hydroxide which has a lower density than the metal oxide, i.e., the metal hydroxide occupies more volume than the metal oxide thereby increasing the volume occupied by the particle. Further examples of swellable inorganic materials can be found in U.S. Application Publication Number US 20110098202, which is hereby incorporated by reference in its entirety. An example for gas filled material is EXPANCEL™ microspheres that are manufactured by and commercially available from Akzo Nobel of Chicago, Ill. These microspheres contain a polymer shell with gas entrapped inside. When these microspheres are heated the gas inside the shell expands and increases the size of the particle. The diameter of the particle can increase 4 times which could result in a volume increase by a factor of 64.

In some embodiments, the treatment fluid stage is a proppant-laden hydraulic fracturing fluid and the first particulates are proppant.

In some embodiments, a system to produce reservoir fluids comprises the wellbore and the fracture resulting from any of the fracturing methods disclosed herein.

In some embodiments, the system may also include a treatment fluid supply unit to supply additional anchorant-rich and anchorant-lean substages of the treatment fluid stage to the wellbore.

In some embodiments, a system to treat a subterranean formation penetrated by a wellbore comprises: a pump system which may comprise one or more pumps to deliver a treatment stage fluid through the wellbore to the formation above a fracturing pressure to form a fracture in the formation; a treatment stage fluid supply unit to continuously distribute solid particulates into the treatment stage fluid, and to introduce an anchorant into the treatment stage fluid; a trigger in the treatment stage fluid to initiate aggregation of the solid particulates in the fracture to form spaced-apart clusters in the fracture; an anchoring system in the treatment fluid stage to anchor the clusters in the fracture and inhibit aggregation of the clusters; and a shut-in system to maintain and then reduce pressure in the fracture to prop the fracture open on the clusters and form interconnected, hydraulically conductive channels between the clusters.

In some embodiments, the initiation of the aggregation of the first solid particulate may comprise gravitational settling of the first solid particulate. In embodiments, the treatment fluid stage may comprise a viscosified carrier fluid, and the trigger may be a breaker.

Following the injection of the fracturing fluid, the well in some embodiments may be shut in or the pressure otherwise sufficiently maintained to keep the fracture from closing. In some embodiments, the gravitational settling of proppant as illustrated may be initiated, e.g., by activation of a trigger to destabilize the fracturing fluid, such as, for example, a breaker and optionally a breaker aid to reduce the viscosity of the fracturing fluid. Anchorants may optionally also settle in the fracture, e.g., at a slower rate than the proppant, which may result in some embodiments from the anchorants having a specific gravity that is equal to or closer to that of the carrier fluid than that of the proppant. As one non-limiting example, the proppant may be sand with a specific gravity of 2.65, the anchorants may be a localized fiber-laden region comprising fiber with a specific gravity of 1.1-1.5, e.g., polylactic acid fibers having a specific gravity of 1.25, and the carrier fluid may be aqueous with a specific gravity of 1-1.1. In this example, the anchorants may have a lower settling rate relative to the proppant. In other embodiments, the anchorants may interact with either or both of the fracture faces, e.g. by friction or adhesion, and may have a density similar or dissimilar to that of the proppant, e.g., glass fibers may have a specific gravity greater than 2.

As a result of differential settling rates according to some embodiments, the proppant forms clusters adjacent respective anchorants, and settling is retarded. Finally, in some embodiments, the anchorants are activated to immobilized anchoring structures to hold the clusters fast against the opposing surface(s) of the fracture. The clusters prop the fracture open to form hydraulically conductive channels between the clusters for the flow of reservoir fluids toward the wellbore during a production phase.

For example, the weight of proppant added per unit volume of carrier fluid may be initially 0.048 g/mL (0.4 lbs proppant added per gallon of carrier fluid (ppa)) and ramped up to 0.48 g/mL (4 ppa) or 0.72 g/mL (6 ppa) or 1.4 g/mL (12 ppa). Concurrently, the fiber-free and fiber-laden substages 36, 34 are alternated, e.g., with the fiber free substages comprising no added fiber or <0.12 g/L and the fiber laden stages comprising 0.12-12 g/L (1-100 lbs/thousand gallons (ppt)) added fiber.

In embodiments, the wellbore may include a substantially horizontal portion, which may be cased or completed open hole, wherein the fracture is transversely or longitudinally oriented and thus generally vertical or sloped with respect to horizontal. A mixing station in some embodiments may be provided at the surface to supply a mixture of carrier fluid from source, any proppant from source, which may for example be an optionally stabilized concentrated blend slurry (CBS) to allow a continuous proppant concentration, any fiber from source, which may for example be a concentrated masterbatch, and any other additives which may be supplied with any of the sources or an additional optional source(s), in any order, such as, for example, viscosifiers, loss control agents, friction reducers, clay stabilizers, biocides, crosslinkers, breakers, breaker aids, corrosion inhibitors, and/or proppant flowback control additives, or the like. In some embodiments, concentrations of one or more additives, including other or additional anchorants and/or anchorant precursors, to the fracturing fluid may be alternated, e.g., in addition to alternating fiber concentration.

The well may if desired also be provided with a shut in valve to maintain pressure in the wellbore and fracture, flow-back/production line to flow back or produce fluids either during or post-treatment, as well as any conventional wellhead equipment.

Maintaining a relatively smooth proppant concentration during pumping in some embodiments enables the stability of the slugs even in a multistage environment because of the relatively insignificant change of the carrier fluid.

The concept according to some embodiments herein can thus minimize interface mixing which may appear during pulsing operations and thus enable better stability, which may in turn provide deeper slug transportation inside the fracture away from the wellbore, which in turn, can provide better channelization.

In some embodiments, the ability of the fracturing fluid to suspend the proppant is reduced after finishing the fracturing treatment and before fracture closure to a level which triggers gravitational settling of the propping agent inside the fracture. For example, the fracturing fluid may be stabilized during placement with a viscosified carrier fluid and destabilized by breaking the viscosity after placement in the fracture and before closure. Proppant settling results in the creation of heterogeneity of proppant distribution inside the fracture because the rate of proppant settling in presence of fiber is significantly slower than without fiber. At some certain concentrations of fiber and propping agent according to embodiments herein, it is possible to enable the creation of stable interconnected proppant free areas and proppant rich clusters which in turn enables high conductivity of the fracture after its closure.

As used herein, the terms "treatment fluid" or "wellbore treatment fluid" are inclusive of "fracturing fluid" or "treatment slurry" and should be understood broadly. These may be or include a liquid, a solid, a gas, and combinations thereof, as will be appreciated by those skilled in the art. A treatment fluid may take the form of a solution, an emulsion, an energized fluid (including foam), slurry, or any other form as will be appreciated by those skilled in the art. In some embodiments, the treatment fluid is an energized fluid that contains a viscosifier which upon breakage enable the clustering of the solid particulates into high strength pillars being stabilized and/or reinforced by anchors.

As used herein, "slurry" refers to an optionally flowable mixture of particles dispersed in a fluid carrier. The terms "flowable" or "pumpable" or "mixable" are used interchangeably herein and refer to a fluid or slurry that has either a yield stress or low-shear (5.11 $s^{-1}$) viscosity less than 1000 Pa and a dynamic apparent viscosity of less than 10 Pa-s (10,000 cP) at a shear rate 170 $s^{-1}$, where yield stress, low-shear viscosity and dynamic apparent viscosity are measured at a temperature of 25° C. unless another temperature is specified explicitly or in context of use.

"Viscosity" as used herein unless otherwise indicated refers to the apparent dynamic viscosity of a fluid at a temperature of 25° C. and shear rate of 170 $s^{-1}$.

"Treatment fluid" or "fluid" (in context) refers to the entire treatment fluid, including any proppant, subproppant particles, liquid, gas etc. "Whole fluid," "total fluid" and "base fluid" are used herein to refer to the fluid phase plus any subproppant particles dispersed therein, but exclusive of proppant particles. "Carrier," "fluid phase" or "liquid phase" refer to the fluid or liquid that is present, which may comprise a continuous phase and optionally one or more discontinuous gas or liquid fluid phases dispersed in the continuous phase, including any solutes, thickeners or colloidal particles only, exclusive of other solid phase particles; reference to "water" in the slurry refers only to water and excludes any gas, liquid or solid particles, solutes, thickeners, colloidal particles, etc.; reference to "aqueous phase" refers to a carrier phase comprised predominantly of water, which may be a continuous or dispersed phase. As used herein the terms "liquid" or "liquid phase" encompasses both liquids per se and supercritical fluids, including any solutes dissolved therein.

The term "dispersion" means a mixture of one substance dispersed in another substance, and may include colloidal or non-colloidal systems. As used herein, "emulsion" generally means any system with one liquid phase dispersed in another immiscible liquid phase, and may apply to oil-in-water and water-in-oil emulsions. Invert emulsions refer to any water-in-oil emulsion in which oil is the continuous or external phase and water is the dispersed or internal phase.

The terms "energized fluid" and "foam" refer to a fluid which when subjected to a low pressure environment liberates or releases gas from solution or dispersion, for example, a liquid containing dissolved gases. Foams or energized fluids are stable mixtures of gases and liquids that form a two-phase system. Foam and energized fluids are generally described by their foam quality, i.e. the ratio of gas volume to the foam volume (fluid phase of the treatment fluid), i.e., the ratio of the gas volume to the sum of the gas plus liquid volumes). If the foam quality is between 52% and 95%, the energized fluid is usually called foam. Above 95%, foam is generally changed to mist. In the present patent application, the term "energized fluid" also encompasses foams and refers to any stable mixture of gas and liquid, regardless of the foam quality. Energized fluids comprise any of:

(a) Liquids that at bottom hole conditions of pressure and temperature are close to saturation with a species of gas. For example the liquid can be aqueous and the gas nitrogen or carbon dioxide. Associated with the liquid and gas species and temperature is a pressure called the bubble point, at which the liquid is fully saturated. At pressures below the bubble point, gas emerges from solution;

(b) Foams, consisting generally of a gas phase, an aqueous phase and a solid phase. At high pressures the foam quality is typically low (i.e., the non-saturated gas volume is low), but quality (and volume) rises as the pressure falls. Additionally, the aqueous phase may have originated as a solid material and once the gas phase is dissolved into the solid phase, the viscosity of solid material is decreased such that the solid material becomes a liquid; or (c) Liquefied gases.

As used herein unless otherwise specified, as described in further detail herein, particle size and particle size distribution (PSD) mode refer to the median volume averaged size. The median size used herein may be any value understood in the art, including for example and without limitation a diameter of roughly spherical particulates. In an embodiment, the median size may be a characteristic dimension, which may be a dimension considered most descriptive of the particles for specifying a size distribution range.

As used herein, a "water soluble polymer" refers to a polymer which has a water solubility of at least 5 wt % (0.5 g polymer in 9.5 g water) at 25° C.

The measurement or determination of the viscosity of the liquid phase (as opposed to the treatment fluid or base fluid) may be based on a direct measurement of the solids-free liquid, or a calculation or correlation based on a measurement(s) of the characteristics or properties of the liquid containing the solids, or a measurement of the solids-containing liquid using a technique where the determination of viscosity is not affected by the presence of the solids. As used herein, solids-free for the purposes of determining the viscosity of the liquid phase means in the absence of non-colloidal particles larger than 1 micron such that the particles do not affect the viscosity determination, but in the presence of any submicron or colloidal particles that may be present to thicken and/or form a gel with the liquid, i.e., in the presence of ultrafine particles that can function as a thickening agent. In some embodiments, a "low viscosity liquid phase" means a viscosity less than about 300 mPa-s measured without any solids greater than 1 micron at 170 $s^{-1}$ and 25° C.

In some embodiments, the treatment fluid may include a continuous fluid phase, also referred to as an external phase, and a discontinuous phase(s), also referred to as an internal phase(s), which may be a fluid (liquid or gas) in the case of an emulsion, foam or energized fluid, or which may be a solid in the case of a slurry. The continuous fluid phase, also referred to herein as the carrier fluid or comprising the carrier fluid, may be any matter that is substantially continuous under a given condition. Examples of the continuous fluid phase include, but are not limited to, water, hydrocarbon, gas (e.g., nitrogen or methane), liquefied gas (e.g., propane, butane, or the like), etc., which may include solutes, e.g. the fluid phase may be a brine, and/or may include a brine or other solution(s). In some embodiments, the fluid phase(s) may optionally include a viscosifying and/or yield point agent and/or a portion of the total amount of viscosifying and/or yield point agent present. Some non-limiting examples of the fluid phase(s) include hydratable gels and mixtures of hydratable gels (e.g. gels containing polysaccharides such as guars and their derivatives, xanthan and diutan and their derivatives, hydratable cellulose derivatives such as hydroxyethylcellulose, carboxymethylcellulose and others, polyvinyl alcohol and its derivatives, other hydratable polymers, colloids, etc.), a cross-linked hydratable gel, a viscosified acid (e.g. gel-based), an emulsified acid (e.g. oil outer phase), an energized fluid (e.g., an $N_2$ or $CO_2$ based foam), a viscoelastic surfactant (VES) viscosified fluid, and an oil-based fluid including a gelled, foamed, or otherwise viscosified oil.

The discontinuous phase if present in the treatment fluid may be any particles (including fluid droplets) that are suspended or otherwise dispersed in the continuous phase in a disjointed manner. In this respect, the discontinuous phase can also be referred to, collectively, as "particle" or "particulate" which may be used interchangeably. As used herein, the term "particle" should be construed broadly. For example, in some embodiments, the particle(s) of the current application are solid such as proppant, sands, ceramics, crystals, salts, etc.; however, in some other embodiments, the particle(s) can be liquid, gas, foam, emulsified droplets, etc. Moreover, in some embodiments, the particle(s) of the current application are substantially stable and do not change shape or form over an extended period of time, temperature, or pressure; in some other embodiments, the particle(s) of the current application are degradable, expandable, swellable, dissolvable, deformable, meltable, sublimeable, or otherwise capable of being changed in shape, state, or structure.

In an embodiment, the particle(s) is substantially round and spherical. In an embodiment, the particle(s) is not substantially spherical and/or round, e.g., it can have varying degrees of sphericity and roundness, according to the API RP-60 sphericity and roundness index. For example, the particle(s) used as anchorants or otherwise may have an aspect ratio of more than 2, 3, 4, 5 or 6. Examples of such non-spherical particles include, but are not limited to, fibers, flocs, flakes, discs, rods, stars, etc. All such variations should be considered within the scope of the current application.

Introducing high-aspect ratio particles into the treatment fluid, e.g., particles having an aspect ratio of at least 6, represents additional or alternative embodiments for stabilizing the treatment fluid and inhibiting settling during proppant placement, which can be removed, for example by dissolution or degradation into soluble degradation products. Examples of such non-spherical particles include, but are not limited to, fibers, flocs, flakes, discs, rods, stars, etc., as described in, for example, U.S. Pat. No. 7,275,596, US20080196896, which are hereby incorporated herein by reference. In an embodiment, introducing ciliated or coated proppant into the treatment fluid may also stabilize or help stabilize the treatment fluid or regions thereof. Proppant or other particles coated with a hydrophilic polymer can make the particles behave like larger particles and/or more tacky particles in an aqueous medium. The hydrophilic coating on a molecular scale may resemble ciliates, i.e., proppant particles to which hairlike projections have been attached to or formed on the surfaces thereof. Herein, hydrophilically coated proppant particles are referred to as "ciliated or coated proppant." Hydrophilically coated proppants and methods of producing them are described, for example, in WO 2011-050046, U.S. Pat. No. 5,905,468, U.S. Pat. No. 8,227,026 and U.S. Pat. No. 8,234,072, which are hereby incorporated herein by reference.

In an embodiment, the particles may be multimodal. As used herein multimodal refers to a plurality of particle sizes or modes which each has a distinct size or particle size distribution, e.g., proppant and fines. As used herein, the terms distinct particle sizes, distinct particle size distribution, or multi-modes or multimodal, mean that each of the plurality of particles has a unique volume-averaged particle size distribution (PSD) mode. That is, statistically, the particle size distributions of different particles appear as distinct peaks (or "modes") in a continuous probability distribution function. For example, a mixture of two particles having normal distribution of particle sizes with similar variability is considered a bimodal particle mixture if their respective means differ by more than the sum of their respective standard deviations, and/or if their respective means differ by a statistically significant amount. In an embodiment, the particles contain a bimodal mixture of two particles; in an embodiment, the particles contain a trimodal mixture of three particles; in an embodiment, the particles contain a tetramodal mixture of four particles; in an embodiment, the particles contain a pentamodal mixture of five particles, and so on. Representative references disclosing multimodal particle mixtures include U.S. Pat. No. 5,518,996, U.S. Pat. No. 7,784,541, U.S. Pat. No. 7,789,146, U.S. Pat. No. 8,008,234, U.S. Pat. No. 8,119,574, U.S. Pat. No. 8,210,249, US 2010/0300688, US 2012/0000641, US 2012/0138296, US 2012/0132421, US 2012/0111563, WO 2012/054456, US 2012/0305245, US 2012/0305254, US 2012/0132421, PCT/RU2011/000971 and U.S. Ser. No. 13/415,025, each of which are hereby incorporated herein by reference.

"Solids" and "solids volume" refer to all solids present in the slurry, including proppant and subproppant particles, including particulate thickeners such as colloids and submicron particles. "Solids-free" and similar terms generally exclude proppant and subproppant particles, except particulate thickeners such as colloids for the purposes of determining the viscosity of a "solids-free" fluid.

"Proppant" refers to particulates that are used in well work-overs and treatments, such as hydraulic fracturing operations, to hold fractures open following the treatment. In some embodiments, the proppant may be of a particle size mode or modes in the slurry having a weight average mean particle size greater than or equal to about 100 microns, e.g., 140 mesh particles correspond to a size of 105 microns. In further embodiments, the proppant may comprise particles or aggregates made from particles with size from 0.001 to 1 mm. All individual values from 0.001 to 1 mm are disclosed and included herein. For example, the solid particulate size may be from a lower limit of 0.001, 0.01, 0.1 or 0.9 mm to an upper limit of 0.009, 0.07, 0.5 or 1 mm. Here particle size is defined is the largest dimension of the grain of said particle.

"Gravel" refers to particles used in gravel packing, and the term is synonymous with proppant as used herein. "Sub-proppant" or "subproppant" refers to particles or particle size or mode (including colloidal and submicron particles) having a smaller size than the proppant mode(s); references to "proppant" exclude subproppant particles and vice versa. In an embodiment, the sub-proppant mode or modes each have a weight average mean particle size less than or equal to about one-half of the weight average mean particle size of a smallest one of the proppant modes, e.g., a suspensive/stabilizing mode.

The proppant, when present, can be naturally occurring materials, such as sand grains. The proppant, when present, can also be man-made or specially engineered, such as coated (including resin-coated) sand, modulus of various nuts, high-strength ceramic materials like sintered bauxite, etc. In some embodiments, the proppant of the current application, when present, has a density greater than 2.45 g/mL, e.g., 2.5-2.8 g/mL, such as sand, ceramic, sintered bauxite or resin coated proppant. In some embodiments, the proppant of the current application, when present, has a density greater than or equal to 2.8 g/mL, and/or the treatment fluid may comprise an apparent specific gravity less than 1.5, less than 1.4, less than 1.3, less than 1.2, less than 1.1, or less than 1.05, less than 1, or less than 0.95, for example. In some embodiments a relatively large density difference between the proppant and carrier fluid may enhance proppant settling during the clustering phase, for example.

In some embodiments, the proppant of the current application, when present, has a density less than or equal to 2.45 g/mL, such as light/ultralight proppant from various manufacturers, e.g., hollow proppant. In some embodiments, the treatment fluid comprises an apparent specific gravity greater than 1.3, greater than 1.4, greater than 1.5, greater than 1.6, greater than 1.7, greater than 1.8, greater than 1.9, greater than 2, greater than 2.1, greater than 2.2, greater than 2.3, greater than 2.4, greater than 2.5, greater than 2.6, greater than 2.7, greater than 2.8, greater than 2.9, or greater than 3. In some embodiments where the proppant may be buoyant, i.e., having a specific gravity less than that of the carrier fluid, the term "settling" shall also be inclusive of upward settling or floating.

In some embodiments, the anchorant is pumped in a stabilized solid laden slurry. Such stabilized laden slurry may be used as the solid particles containing slurry during the job or just during transportation and would thus be diluted when arriving on site. "Stable" or "stabilized" or similar terms refer to a concentrated blend slurry (CBS) wherein gravitational settling of the particles is inhibited such that no or minimal free liquid is formed, and/or there is no or minimal rheological variation among strata at different depths in the CBS, and/or the slurry may generally be regarded as stable over the duration of expected CBS storage and use conditions, e.g., a CBS that passes a stability test or an equivalent thereof. In an embodiment, stability can be evaluated following different settling conditions, such as for example static under gravity alone, or dynamic under a vibratory influence, or dynamic-static conditions employing at least one dynamic settling condition followed and/or preceded by at least one static settling condition.

The static settling test conditions can include gravity settling for a specified period, e.g., 24 hours, 48 hours, 72 hours, or the like, which are generally referred to with the respective shorthand notation "24 h-static", "48 h-static" or "72 h static". Dynamic settling test conditions generally indicate the vibratory frequency and duration, e.g., 4 h@15 Hz (4 hours at 15 Hz), 8 h@5 Hz (8 hours at 5 Hz), or the like. Dynamic settling test conditions are at a vibratory amplitude of 1 mm vertical displacement unless otherwise indicated. Dynamic-static settling test conditions will indicate the settling history preceding analysis including the total duration of vibration and the final period of static conditions, e.g., 4 h@15 Hz/20 h-static refers to 4 hours vibration followed by 20 hours static, or 8 h@15 Hz/10 d-static refers to 8 hours total vibration, e.g., 4 hours vibration followed by 20 hours static followed by 4 hours vibration, followed by 10 days of static conditions. In the absence of a contrary indication, the designation "8 h@15 Hz/10 d-static" refers to the test conditions of 4 hours vibration, followed by 20 hours static followed by 4 hours vibration, followed by 10 days of static conditions. In the absence of specified settling conditions, the settling condition is 72 hours static. The stability settling and test conditions are at 25° C. unless otherwise specified.

As used herein, a concentrated blend slurry (CBS) may meet at least one of the following conditions:

(1) the slurry has a low-shear viscosity equal to or greater than 1 Pa-s (5.11 $s^{-1}$, 25° C.);

(2) the slurry has a Herschel-Bulkley (including Bingham plastic) yield stress (as determined in the manner described herein) equal to or greater than 1 Pa; or (3) the largest particle mode in the slurry has a static settling rate less than 0.01 mm/hr; or (4) the depth of any free fluid at the end of a 72-hour static settling test condition or an 8 h@15 Hz/10 d-static dynamic settling test condition (4 hours vibration followed by 20 hours static followed by 4 hours vibration followed finally by 10 days of static conditions) is no more than 2% of total depth; or (5) the apparent dynamic viscosity (25° C., 170 $s^{-1}$) across column strata after the 72-hour static settling test condition or the 8 h@15 Hz/10 d-static dynamic settling test condition is no more than +/−20% of the initial dynamic viscosity; or (6) the slurry solids volume fraction (SVF) across the column strata below any free water layer after the 72-hour static settling test condition or the 8 h@15 Hz/10 d-static dynamic settling test condition is no more than 5% greater than the initial SVF; or (7) the density across the column strata below any free water layer after the 72-hour static settling test condition or the 8 h@15 Hz/10 d-static dynamic settling test condition is no more than 1% of the initial density.

In some embodiments, the concentrated blend slurry comprises at least one of the following stability indicia: (1) an SVF of at least 0.4 up to SVF=PVF; (2) a low-shear viscosity of at least 1 Pa-s (5.11 $s^{-1}$, 25° C.); (3) a yield stress (as determined herein) of at least 1 Pa; (4) an apparent viscosity of at least 50 mPa-s (170 $s^{-1}$, 25° C.); (5) a multimodal solids phase; (6) a solids phase having a PVF greater than 0.7; (7) a viscosifier selected from viscoelastic surfactants, in an amount ranging from 0.01 up to 7.2 g/L (60 ppt), and hydratable gelling agents in an amount ranging from 0.01 up to 4.8 g/L (40 ppt) based on the volume of fluid phase; (8) colloidal particles; (9) a particle-fluid density delta less than 1.6 g/mL, (e.g., particles having a specific gravity less than 2.65 g/mL, carrier fluid having a density greater than 1.05 g/mL or a combination thereof); (10) particles having an aspect ratio of at least 6; (11) ciliated or coated proppant; and (12) combinations thereof.

In an embodiment, the concentrated blend slurry is formed (stabilized) by at least one of the following slurry stabilization operations: (1) introducing sufficient particles into the slurry or treatment fluid to increase the SVF of the treatment fluid to at least 0.4; (2) increasing a low-shear viscosity of the slurry or treatment fluid to at least 1 Pa-s (5.11 $s^{-1}$, 25° C.); (3) increasing a yield stress of the slurry or treatment fluid to at least 1 Pa; (4) increasing apparent viscosity of the slurry or treatment fluid to at least 50 mPa-s (170 $s^{-1}$, 25° C.); (5) introducing a multimodal solids phase into the slurry or treatment fluid; (6) introducing a solids phase having a PVF greater than 0.7 into the slurry or treatment fluid; (7) introducing into the slurry or treatment fluid a viscosifier selected from viscoelastic surfactants, e.g., in an amount ranging from 0.01 up to 7.2 g/L (60 ppt), and hydratable gelling agents, e.g., in an amount ranging from 0.01 up to 4.8 g/L (40 ppt) based on the volume of fluid phase; (8) introducing colloidal particles into the slurry or treatment fluid; (9) reducing a particle-fluid density delta to less than 1.6 g/mL (e.g., introducing particles having a specific gravity less than 2.65 g/mL, carrier fluid having a density greater than 1.05 g/mL or a combination thereof); (10) introducing particles into the slurry or treatment fluid having an aspect ratio of at least 6; (11) introducing ciliated or coated proppant into slurry or treatment fluid; and (12) combinations thereof. The slurry stabilization operations may be separate or concurrent, e.g., introducing a single viscosifier may also increase low-shear viscosity, yield stress, apparent viscosity, etc., or alternatively or additionally with respect to a viscosifier, separate agents may be added to increase low-shear viscosity, yield stress and/or apparent viscosity.

Increasing carrier fluid viscosity in a Newtonian fluid also proportionally increases the resistance of the carrier fluid motion. In some embodiments, the carrier fluid has a lower limit of apparent dynamic viscosity, determined at 170 $s^{-1}$ and 25° C., of at least about 10 mPa-s, or at least about 25 mPa-s, or at least about 50 mPa-s, or at least about 75 mPa-s, or at least about 100 mPa-s, or at least about 150 mPa-s, or at least about 300 mPa-s, or at least about 500 mPa-s. A disadvantage of increasing the viscosity is that as the viscosity increases, the friction pressure for pumping the slurry generally increases as well. In some embodiments, the fluid carrier has an upper limit of apparent dynamic viscosity, determined at 170 $s^{-1}$ and 25° C., of less than about 1000 mPa-s, or less than about 500 mPa-s, or less than about 300 mPa-s, or less than about 150 mPa-s, or less than about 100 mPa-s, or less than about 50 mPa-s. In an embodiment, the fluid phase viscosity ranges from any lower limit to any higher upper limit.

In some embodiments, an agent may both viscosify and impart yield stress characteristics, and in further embodiments may also function as a friction reducer to reduce friction pressure losses in pumping the treatment fluid. In an embodiment, the liquid phase is essentially free of viscosifier or comprises a viscosifier in an amount ranging from 0.01 up to 12 g/L (0.08-100 ppt) of the fluid phase. The viscosifier can be a viscoelastic surfactant (VES) or a hydratable gelling agent such as a polysaccharide, which may be crosslinked. When using viscosifiers and/or yield stress fluids, proppant settling in some embodiments may be triggered by breaking the fluid using a breaker(s). In some embodiments, the slurry is stabilized for storage and/or pumping or other use at the surface conditions and proppant transport and placement, and settlement triggering is achieved downhole at a later time prior to fracture closure, which may be at a higher temperature, e.g., for some formations, the temperature difference between surface and downhole can be significant and useful for triggering degradation of the viscosifier, any stabilizing particles (e.g., subproppant particles) if present, a yield stress agent or characteristic, and/or a activation of a breaker. Thus in some embodiments, breakers that are either temperature sensitive or time sensitive, either through delayed action breakers or delay in mixing the breaker into the slurry to initiate destabilization of the slurry and/or proppant settling, can be useful.

In embodiments, the fluid may include leakoff control agents, such as, for example, latex dispersions, water soluble polymers, submicron particulates, particulates with an aspect ratio higher than 1, or higher than 6, combinations thereof and the like, such as, for example, crosslinked polyvinyl alcohol microgel. The fluid loss agent can be, for example, a latex dispersion of polyvinylidene chloride, polyvinyl acetate, polystyrene-co-butadiene; a water soluble polymer such as hydroxyethylcellulose (HEC), guar, copolymers of polyacrylamide and their derivatives; particulate fluid loss control agents in the size range of 30 nm to 1 micron, such as γ-alumina, colloidal silica, CaCO3, SiO2, bentonite etc.; particulates with different shapes such as glass fibers, flocs, flakes, films; and any combination thereof or the like. Fluid loss agents can if desired also include or be used in combination with acrylamido-methyl-propane sulfonate polymer (AMPS). In an embodiment, the leak-off control agent comprises a reactive solid, e.g., a hydrolyzable material such as PGA, PLA or the like; or it can include a soluble or solubilizable material such as a wax, an oil-soluble resin, or another material soluble in hydrocarbons, or calcium carbonate or another material soluble at low pH; and so on. In an embodiment, the leak-off control agent comprises a reactive solid selected from ground quartz, oil soluble resin, degradable rock salt, clay, zeolite or the like. In other embodiments, the leak-off control agent comprises one or more of magnesium hydroxide, magnesium carbonate, magnesium calcium carbonate, calcium carbonate, aluminum hydroxide, calcium oxalate, calcium phosphate, aluminum metaphosphate, sodium zinc potassium polyphosphate glass, and sodium calcium magnesium polyphosphate glass, or the like. The treatment fluid may also contain colloidal particles, such as, for example, colloidal silica, which may function as a loss control agent, gellant and/or thickener.

In embodiments, the proppant-containing treatment fluid may comprise from 0.06 or 0.12 g of proppant per mL of treatment fluid (corresponding to 0.5 or 1 ppa) up to 1.2 or 1.8 g/mL (corresponding to 10 or 15 ppa). In some embodiments, the proppant-laden treatment fluid may have a relatively low proppant loading in earlier-injected fracturing fluid and a relatively higher proppant loading in later-injected fracturing fluid, which may correspond to a relatively narrower fracture width adjacent a tip of the fracture and a relatively wider fracture width adjacent the wellbore. For example, the proppant loading may initially begin at 0.48 g/mL (4 ppa) and be ramped up to 0.6 g/mL (6 ppa) at the end.

Figure 1B:
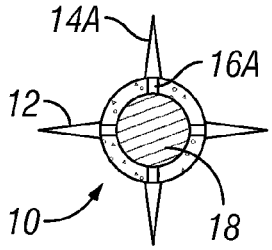
FIG. 1B shows a schematic transverse section of the horizontal well of FIG. 1A as seen along the lines 1B-1B.
Figure 1C:
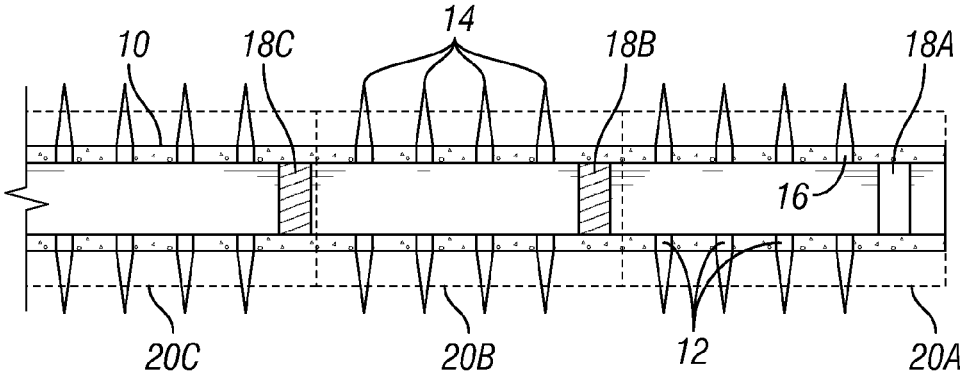
FIG. 1C shows a schematic of a horizontal well with a plurality of stages of perforation clusters according to embodiments.

With reference to the embodiments of FIGS. 1A-1B, a cased and cemented horizontal well 10 is configured to receive a treatment stage for simultaneously introducing treatment fluid through a plurality of perforations 12, creating at least one fracture or a plurality of fractures, or multiple fractures 14A, 14B, 14C, 14D. The treatment stage in these embodiments is provided with four corresponding cluster sets 16A, 16B, 16C, 16D to form the respective fractures 14A, 14B, 14C, 14D. Four cluster sets are shown for purposes of illustration and example, but the invention is not limited to any particular number of cluster sets in the stage. Each cluster set 16A, 16B, 16C, 16D is provided with a plurality of radially arrayed perforations 12 (see FIG. 1B). A fracture plug 108, which may be mechanical, chemical or particulate-based (e.g., sand), may be provided to isolate the stage for treatment. The treatment stage may have the number and/or size of the perforations in the individual clusters and/or the number of clusters determined for the appropriate amount and rate of proppant to be delivered. The amount of proppant delivered to each fracture is generally determined by the relative number of perforations in the particular cluster associated with the respective fracture in question and sometimes the geomechanical stress in the rock surrounding said cluster.

With reference to the plural stage embodiments of FIG. 10, three stages 20A, 20B, 20C are shown for purposes of illustrating and exemplifying multistage embodiments of the FIG. 10 arrangement, but the invention is not limited to any particular number of stages. Each stage 20A, 20B, 20C in these embodiments is provided with four cluster sets 16 to form the respective fractures 14, as in FIG. 10. The fracture plugs 18A, 18B, 18C are provided to isolate each respective stage 20A, 20B, 20C for treatment. As in FIG. 10, the fracture plugs may be mechanical, chemical or particulate-based, each stage may have the number and/or size of the perforations in the individual clusters and/or the number of clusters determined for the appropriate amount and rate of proppant to be delivered for the particular stage; and the amount of proppant delivered to each fracture is also generally determined by the relative number of perforations in the particular cluster associated with the fracture in question. In particular embodiments, the fracture plugs may be formed by bridging the solids in the treatment slurry, and/or optionally debridged by re-slurrying the solids in the treatment fluid.

Figure 2A:
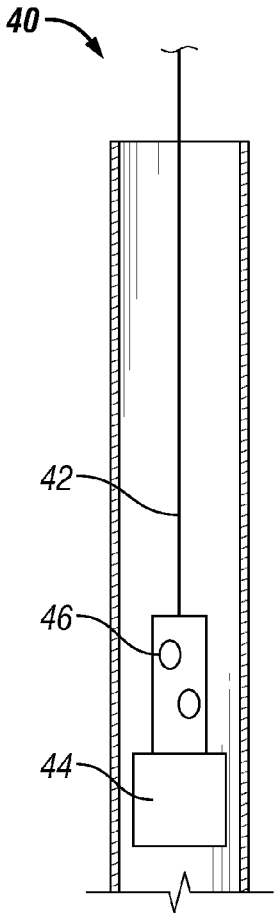
FIGS. 2A-2C schematically illustrate a wireline completion staging system or tool according to some embodiments of the present disclosure.
Figure 2B:
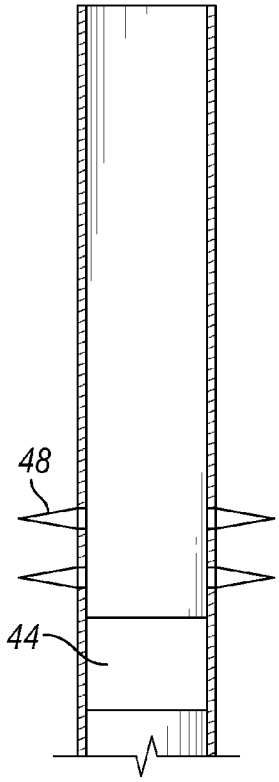
Figure 2C:
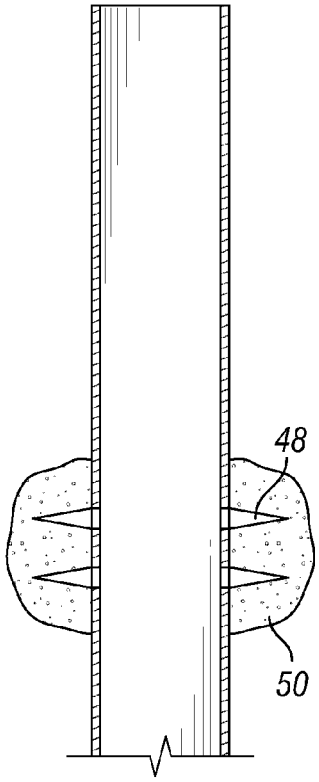

With reference to FIGS. 2A-2C, in embodiments the downhole completion staging system or tool 40 comprises a wireline tool string 42 made up of a blanking plug 44 and perforating guns 46. In the so-called "plug and perf" completion system, the wireline tool string 42 is run-in-hole in embodiments as shown in FIG. 2A. The tool string 42 includes the blanking plug 44 and perforating guns 46. The blanking plug 44 is positioned and set in the wellbore, and one or more perforation clusters 48 are then placed in the wellbore above the wireline plug, as shown in FIG. 2B in embodiments. The wireline equipment is recovered to surface. A fracture treatment is then circulated down the wellbore to the formation to form fracture(s) 50 adjacent the perforations 48, as shown in FIG. 2C. In embodiments the fracture treatment is circulated into the wellbore with the treatment fluid.

In other embodiments, the so-called just-in-time perforating (JITP) technique is employed using the treatment fluid. As used herein, JITP refers to a multizone perforation method wherein the perforating device is moved within the wellbore between stages without removing it from the wellbore between stages so that perforation of serial stages can proceed continuously and sequentially. The JITP technique is known from, for example, U.S. Pat. No. 6,394,184, U.S. Pat. No. 6,520,255, U.S. Pat. No. 6,543,538, U.S. Pat. No. 6,575,247, US 2009/0114392, SPE-152100, and King, Optimize multizone fracturing, E&P Magazine (Aug. 29, 2007), which are hereby incorporated herein by reference. Briefly, in embodiments, the method comprises perforating an interval in a wellbore with a perforating device, injecting a treatment fluid into the perforations created without removing the perforating device from the wellbore, moving the perforating device away from the perforations created before or after the treatment fluid injection, deploying a diversion agent to block further flow into the perforations created, and repeating the perforation and injection for one or more additional intervals, wherein a treatment fluid is used in the injection, or as a flush fluid circulated in the wellbore after the injection, or a combination thereof. In embodiments, the diversion agent(s) may be selected from one or more of mechanical devices such as bridge plugs, packers, down-hole valves, sliding sleeves, and baffle/plug combinations; ball sealers; particulates such as sand, ceramic material, proppant, salt, waxes, resins, or other compounds; or by alternative fluid systems such as viscosified fluids, gelled fluids, or foams, or other chemically formulated fluids.

In embodiments, the JITP method may coordinate pumping and perforating, e.g., a wireline or coiled tubing assembly of perforating guns for a plurality (e.g., 6-11) perforation sets is run into the wellbore, a set of perforations is made, then the perforating guns are pulled above the next zone to be perforated, and the treatment fluid is injected into the just-perforated zone, while the perforating guns are slowly lowered to the next zone to be perforated. In embodiments, at the end of the treatment fluid injection, a diversion agent such as ball sealers, for example, is delivered to the perforations just treated in the flush fluid circulated between stages, and if desired, the flush fluid behind the ball sealers may be used as the pad and/or treatment fluid for treatment of the next perforated interval. In some embodiments, sealing of the open perforations with the ball sealers or other diversion agent is confirmed by a rapid increase in the wellhead pressure, indicating that the next zone can be immediately perforated, e.g., while maintaining an overbalanced condition to maintain the diversion agent to block flow to the existing perforations and/or the previously treated intervals. In embodiments, the treatment fluid described herein is employed in the injection step, as the pad or flush fluid, or as any combination thereof.

With reference to FIGS. 3A-6B, in embodiments the downhole completion staging system or tool comprises a sleeve-based system. Generally, sliding sleeves in the closed position are fitted to the production liner. The production liner is placed in a hydrocarbon formation. An object is introduced into the wellbore from surface, and the object is transported to the target zone by the flow field. When at the target location, the object is caught by the sliding sleeve and shifts the sleeve to the open position. The object remains in the sleeve, obstructing hydraulic communication from above to below. A fracture treatment is then circulated down the wellbore to the formation adjacent the open sleeve. In embodiments the fracture treatment is circulated into the wellbore with the treatment fluid. Representative examples of sleeve-based systems are disclosed in U.S. Pat. No. 7,387,165, U.S. Pat. No. 7,322,417, U.S. Pat. No. 7,377,321, US 2007/0107908, US 2007/0044958, US 2010/0209288, U.S. Pat. No. 7,387,165, US2009/0084553, U.S. Pat. No. 7,108,067, U.S. Pat. No. 7,431,091, U.S. Pat. No. 7,543,634, U.S. Pat. No. 7,134,505, U.S. Pat. No. 7,021,384, U.S. Pat. No. 7,353,878, U.S. Pat. No. 7,267,172, U.S. Pat. No. 7,681,645, U.S. Pat. No. 7,066,265, U.S. Pat. No. 7,168,494, U.S. Pat. No. 7,353,879, U.S. Pat. No. 7,093,664, and U.S. Pat. No. 7,210,533, which are hereby incorporated herein by reference.

FIGS. 3A-3E illustrate embodiments employing a TEST AND PRODUCE (TAP) cased hole system disclosed in U.S. Pat. No. 7,387,165, U.S. Pat. No. 7,322,417, U.S. Pat. No. 7,377,321. Briefly the system includes a series of valves 60 for isolating multiple production zones. Each valve 60 includes a valve sleeve 62 moveable between a closed position blocking radial openings in an outer housing 64 and an open position where the radial openings are exposed. The valve 60 also includes a piston 66 and a collapsible seat 68 which is movable between a pass through state, allowing a ball or dart to pass through it, and a ball or dart catching state.

Figure 3A:
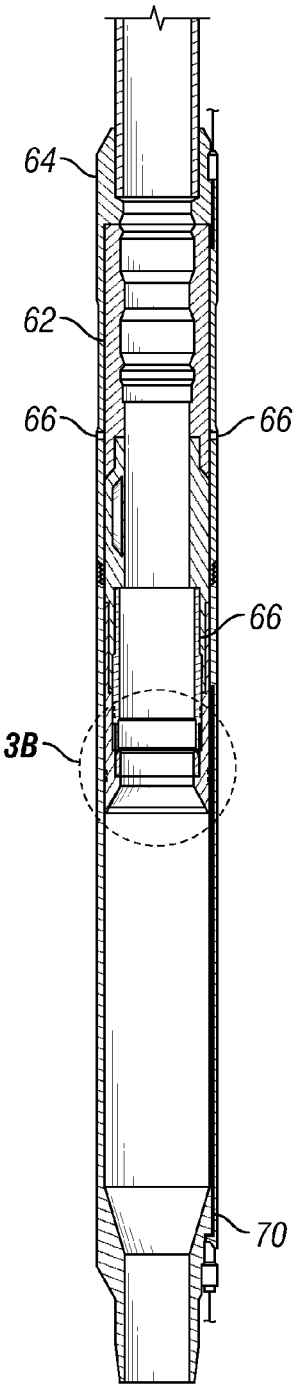
FIGS. 3A-3E schematically illustrate a sleeve-based completion staging system tool according to some embodiments of the present disclosure.
Figure 3B:
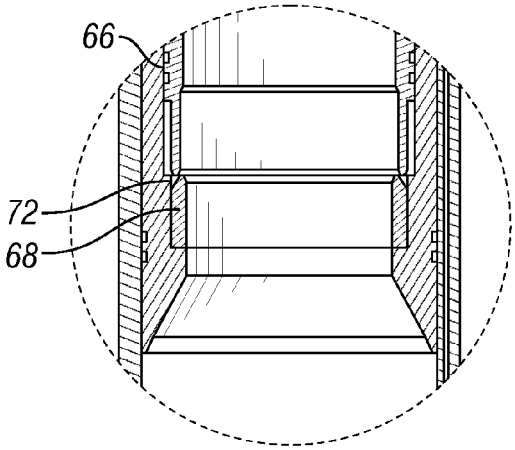
Figure 3C:
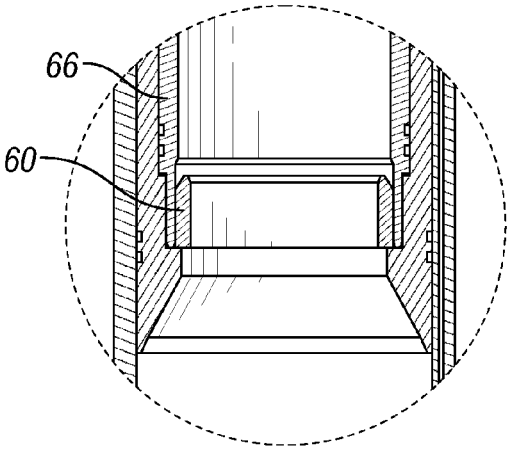
Figure 3D:
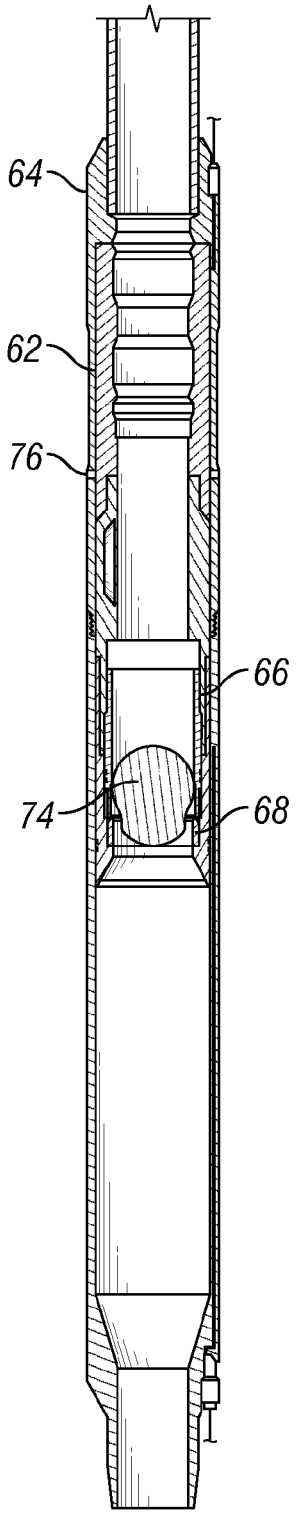

To isolate a zone, first the seat 68 is collapsed by increasing pressure through control line 70 to move piston 66 downwardly as shown viewing FIGS. 3B and 3C together. This downward movement causes mating slanted surfaces 72 of the piston 66 and C-ring 68 to interact to close the C-ring. The C-ring is now in position to catch a ball or dart as shown in FIG. 3D. Dart 74 can now be dropped and caught by C-ring 68. The dart 74 and C-ring 68 now form a fluid tight barrier. Pumping fluid against the dart 74 shears a pin 76 allowing the valve sleeve 62 to move downwardly and out of blocking engagement with the radial openings. A treatment fluid can then be injected through the fracture port openings and into the formation.

Figure 3E:
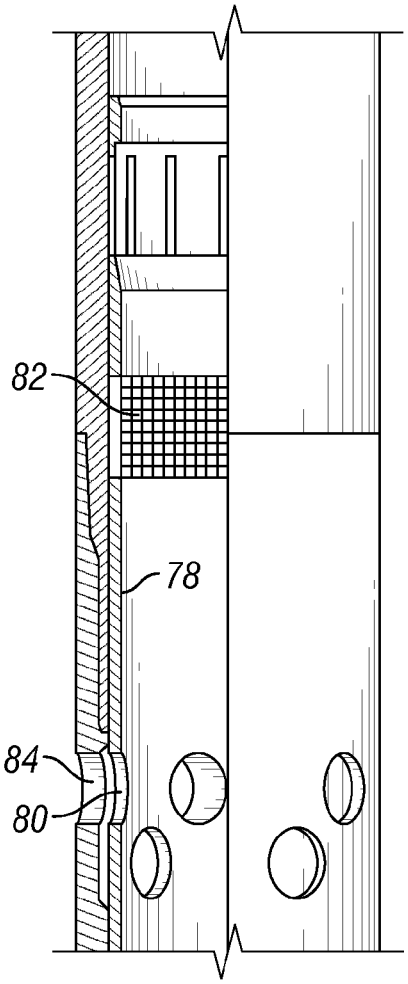

In different embodiments shown in FIG. 3E, the sleeve 78 includes a first set of ports 80 and another set of ports adjacent to a filter 82. This assembly works exactly like the one in FIGS. 3A-3D except with pressure down on the dart there are two positions: an open valve "treating" position where ports 80 and 84 are aligned, and an open port producing position where the filter 82 is adjacent to ports 84 to inhibit proppant or sand from leaving the formation.

Figure 4A:
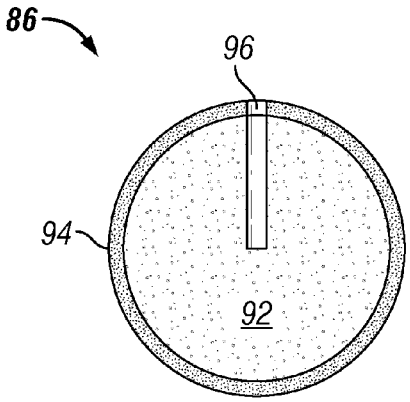
FIGS. 4A-4C schematically illustrate activating objects used in a sleeve-based completion staging system or tool according to some embodiments of the present disclosure.
Figure 4B:
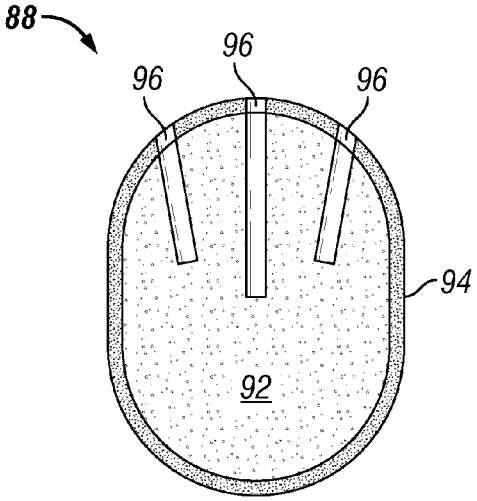
Figure 4C:
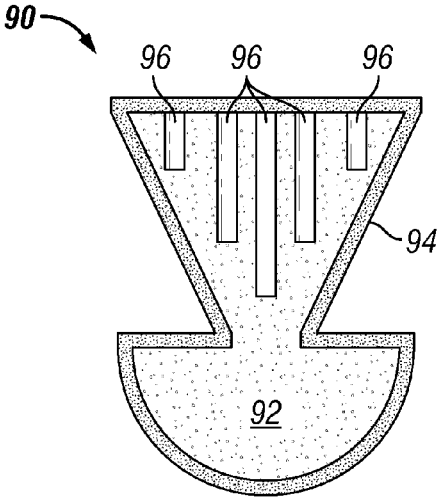

FIGS. 4A-4C illustrate embodiments for dissolvable materials as disclosed in US 2007/0107908, US 2007/0044958, US 2010/0209288. Briefly, a ball 86, 88 or a dart 90 is made up of inner material 92 which is a combination of an insoluble metal and a soluble additive so that the combination forms a high strength material that is dissolvable in an aqueous solution. This inner material 92 is then coated with an insoluble protective layer 94 to delay the dissolution. The ball 88, 90 or dart 92 may include openings 96 drilled into the ball to allow dissolving of the ball or dart to begin immediately upon dropping the ball into the well.

The rate of dissolution of the ball 10, 20 or dart 30 can be controlled by altering the type and amount of the additive or altering the number or size of the openings 16.

Figure 5A:
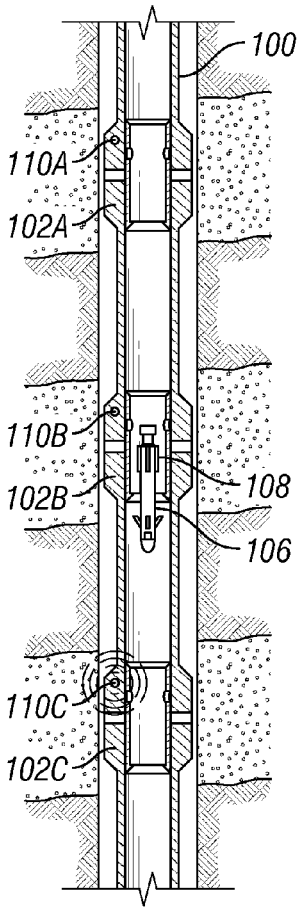
FIGS. 5A-5C schematically illustrate an RFID based dart-sleeve completion staging system tool according to some embodiments of the present disclosure.
Figure 5B:
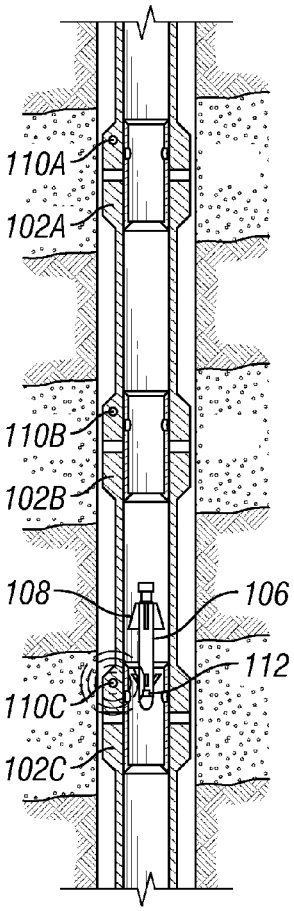
Figure 5C:
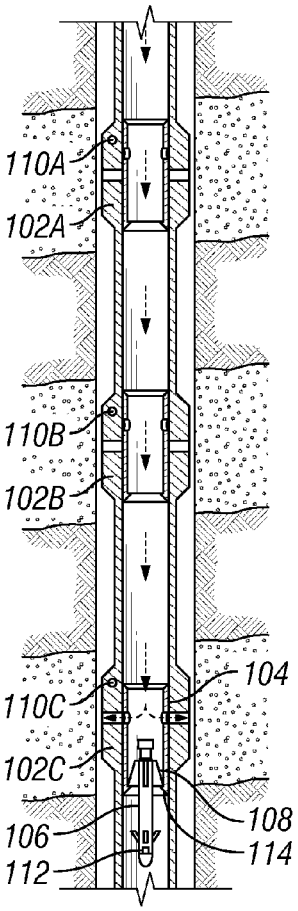

FIGS. 5A-5C illustrate a smart dart system disclosed in U.S. Pat. No. 7,387,165, US2009/0084553. Briefly, in these embodiments a casing 100 is cemented in place and a number of valves 102A-C are provided integral with the casing. Each valve 102A-C has a movable sleeve 104 (see FIG. 5C) and seat of the same size. However, the seat is not collapsible. Instead, the dart 106 is deployed with its fins 108 collapsed. To actuate the fins, each valve 102A-C has a transmitter 110A-C which emits a unique RF signal, and each dart in turn includes a receiver 112 for receiving a particular target RF signal. As the dart 106 comes into proximity with a valve emitting its target RF signal, the fins 108 spring radially outwardly into a position to engage a seat and form a seal. Continuing to pump down on the dart then enables the sleeve 114 to be lowered to expose a fracture port and allow the fracture treatment fluid to enter the formation.

Figure 6B:
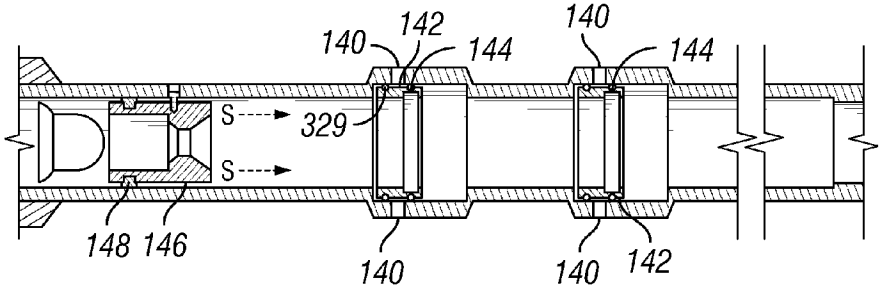
FIGS. 6A-6B schematically illustrate a further sleeve-based completion staging system or tool according to some embodiments of the present disclosure.
Figure 6A:
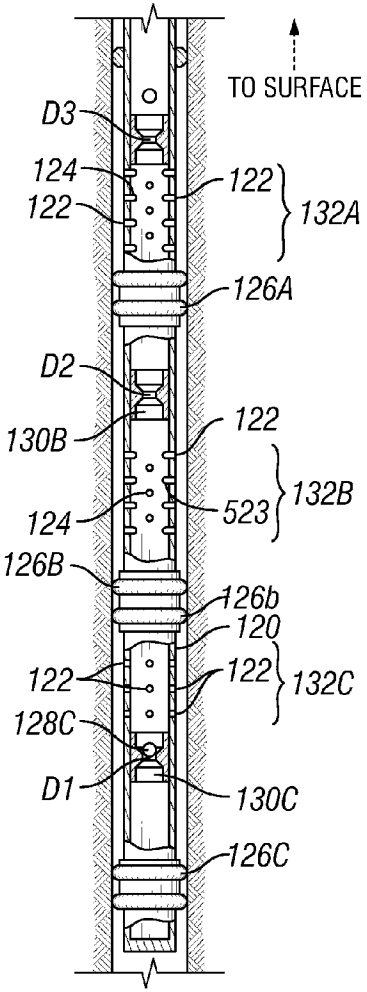

The multistage system shown in FIGS. 6A-6B is an open hole system. With reference to FIG. 6A, the assembly includes a tubing 120 with preformed ports 122 that are covered by shearable end caps 124. The tubing 120 is run in hole with all of the ports covered and then packers 126A-C are set to isolate various zones of interest in the formation. When ready to stimulate, a ball 128C is dropped from surface to seat into seat D1 in sliding sleeve 130C, thus creating a barrier in the sliding sleeve. Fluid can then be pumped down on the ball 128C to push the sliding sleeve 130C downwardly to shear the end caps 124 in the area of ported interval 132C. With these end caps sheared, ports 122 in the area of ported interval 132C are opened, and the ball/sleeve interface creates a barrier below the ported interval 132C. Thus, a treatment fluid can be directed through the ports 122 in ported interval 132C and packers 126B and 126C will isolate the flow to the adjacent formation in the area of ported interval 132C. To stimulate the next zones, succesively larger balls are dropped into respective succesively larger seats D2, D3 near the succesively higher formation zones causing end caps in intervals 132B, 132A to shear, blocking flow below the respective interval, allowing a treatment fluid to be directed through the ports 122 in the respective ported interval.

FIG. 6B operates in a similar manner except instead of using end caps, each port 140 is initially covered by a port blocking sleeve 142. Each port blocking sleeve 142 includes a recess 144 such that when the sliding sleeve 146 engages it, dogs 148 on the sliding sleeve 146 spring outwardly into the respective recess 144 allowing the sliding sleeve 146 to lock with the port blocking sleeve 142 and pull it downwardly to uncover the ports. As shown, there can be a series of port blocking sleeves 142 within the same zone each of which can be moved by the sliding sleeve 146. The remainder of this embodiment is identical to the previously described embodiment. That is, the ball/sleeve interface creates a barrier below the ports to direct a treatment fluid into a formation of interest. Packers isolate the formation above and below the ports, and after a treatment has been performed a larger ball can be dropped into a large seat near a next higher formation zone.

Figure 7A:
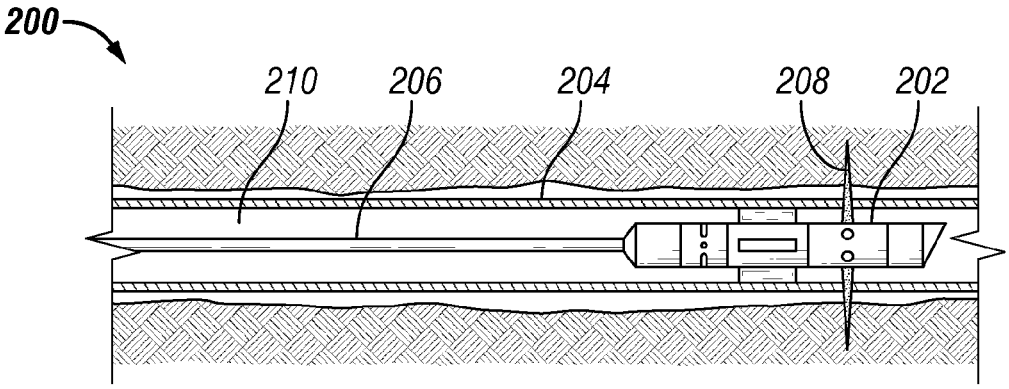
FIGS. 7A-7E schematically illustrate a jetting completion staging system or tool according to some embodiments of the present disclosure.
Figure 7B:
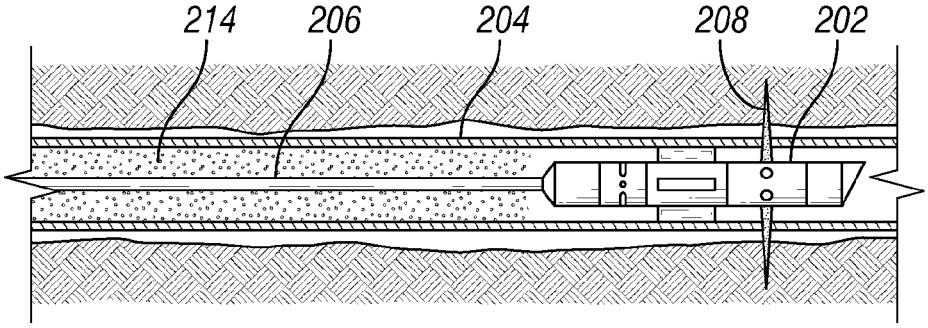
Figure 7C:
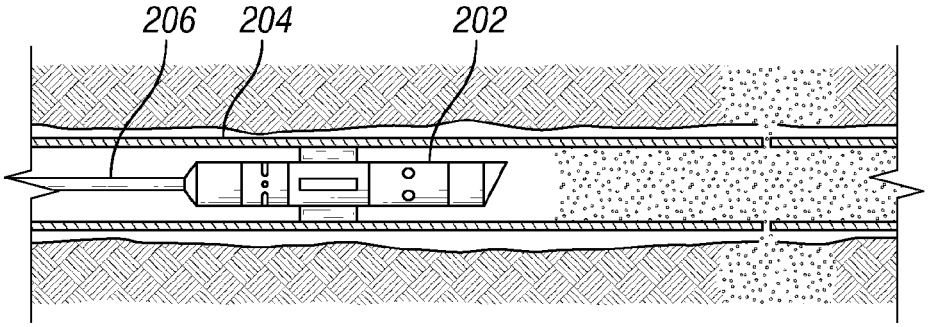
Figure 7D:
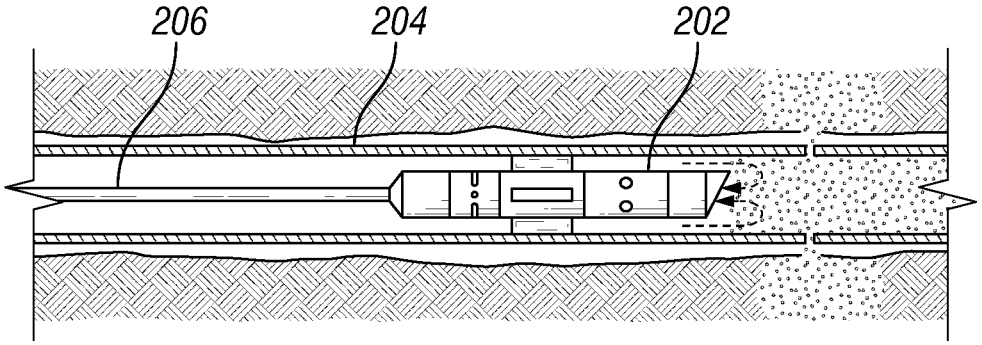
Figure 7E:
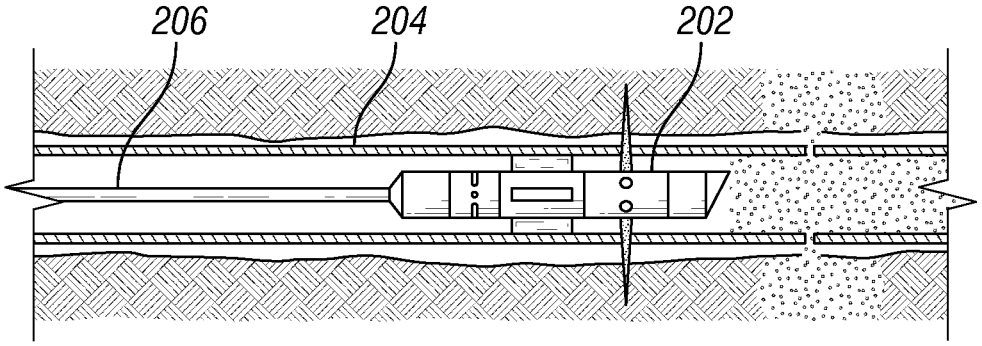

With reference to FIGS. 7A-7E, in embodiments the downhole completion staging system or tool 200 comprises a jetting assembly fitted to the lower end of the pipe. The jetting assembly 202 is positioned adjacent the zone of interest, and the casing 204 is perforated by circulating abrasive materials down the tubing 206 through the jetting assembly into jets 208 as shown in the embodiments of FIGS. 7A-7B. The annulus 210 is closed in to enable breaking down the perforations 212. The fracture treatment is then pumped down the annulus. The tool string can be moved up the way, and act as a dead string for fracture diagnostics. A final proppant stage of non-crosslinked fluid with high proppant concentration is then pumped to induce a near-wellbore proppant pack that can act as a diversion for subsequent treatments up the way. In embodiments the fracture treatment is circulated into the wellbore with the treatment fluid.

In embodiments, the downhole completion staging system or tool comprises a bottom hole assembly (BHA) equipped with perforating guns, mechanical set packer and circulating valve. When at depth, the casing is shot with a perforating gun. The string is then lowered and the packer is set below the perforations, and the circulation valve is closed. A fracture treatment is then circulated down the annular side of the wellbore to the formation adjacent the perforations. In embodiments the fracture treatment is circulated into the wellbore with the treatment fluid. After the frac is placed, the circulation is opened and the wellbore may be cleaned up. In embodiments, the treatment fluid is circulated in the wellbore for cleanup. The process is then repeated for the next zone up the way.

The treatment fluid may be prepared on location, e.g., at the wellsite when and as needed using conventional treatment fluid blending equipment.

In some embodiment, there is provided a wellsite equipment configuration for a land-based fracturing operation using the principles disclosed herein. The proppant is contained in sand trailers. Anchors may also be contained in a trailer. Water tanks are arranged along one side of the operation site. Hopper receives sand from the sand trailers and distributes it into the mixer truck. Blender is provided to blend the carrier medium (such as brine, viscosified fluids, etc.) with the proppant, i.e., "on the fly," and then the slurry is discharged to manifold. The final mixed and blended slurry, also called frac fluid, is then transferred to the pump trucks, and routed at treatment pressure through treating line to rig, and then pumped downhole. This configuration eliminates the additional mixer truck(s), pump trucks, blender(s), manifold(s) and line(s) normally required for slickwater fracturing operations, and the overall footprint is considerably reduced.

In some embodiments, the wellsite equipment configuration may be provided with the additional feature of delivery of pump-ready treatment fluid delivered to the wellsite in trailers to and further elimination of the mixer, hopper, and/or blender. In some embodiments the treatment fluid is prepared offsite and pre-mixed with proppant, anchors and other additives, or with some or all of the additives except proppant, such as in a system described in co-pending co-assigned patent applications with application Ser. No. 13/415,025, filed on Mar. 8, 2012, and application Ser. No. 13/487,002, filed on Jun. 1, 2012, the entire contents of which are incorporated herein by reference in their entireties. As used herein, the term "pump-ready" should be understood broadly. In certain embodiments, a pump-ready treatment fluid means the treatment fluid is fully prepared and can be pumped downhole without being further processed. In some other embodiments, the pump-ready treatment fluid means the fluid is substantially ready to be pumped downhole except that a further dilution may be needed before pumping or one or more minor additives need to be added before the fluid is pumped downhole. In such an event, the pump-ready treatment fluid may also be called a pump-ready treatment fluid precursor. In some further embodiments, the pump-ready treatment fluid may be a fluid that is substantially ready to be pumped downhole except that certain incidental procedures are applied to the treatment fluid before pumping, such as low-speed agitation, heating or cooling under exceptionally cold or hot climate, etc.

While the disclosure has provided specific and detailed descriptions to various embodiments, the same is to be considered as illustrative and not restrictive in character. Only certain example embodiments have been shown and described. Those skilled in the art will appreciate that many modifications are possible in the example embodiments without materially departing from the disclosure. Accordingly, all such modifications are intended to be included within the scope of this disclosure as defined in the following claims.

In reading the claims, it is intended that when words such as "a," "an," "at least one," or "at least one portion" are used there is no intention to limit the claim to only one item unless specifically stated to the contrary in the claim. When the language "at least a portion" and/or "a portion" is used the item can include a portion and/or the entire item unless specifically stated to the contrary. In the claims, means-plus-function clauses are intended to cover the structures described herein as performing the recited function and not only structural equivalents, but also equivalent structures. For example, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. §112, paragraph 6 for any limitations of any of the claims herein, except for those in which the claim expressly uses the words 'means for' together with an associated function.

I claim:

1. A method, comprising:

placing a downhole completion staging system tool in a wellbore adjacent a subterranean formation;

operating the downhole completion staging system tool to establish one or more passages for fluid communication between the wellbore and the subterranean formation in a plurality of wellbore stages spaced along the wellbore;

isolating one of the wellbore stages for treatment;

injecting an in situ channelization treatment fluid through the wellbore and the one or more passages of the isolated wellbore stage into the subterranean formation to form within a fracture a homogeneous region of continuously uniform distribution of solid particulates and thereafter aggregate the solid particulates to place clusters in the fracture; and repeating the isolation and clusters placement for one or more additional stages wherein the in situ channelization treatment fluid comprises a viscosified carrier fluid, the solid particulates, a breaker, and at least an anchorant, the breaker inducing settling of the solid particulates prior to closure of the fracture.

2. The method of claim 1, wherein the placement of the downhole completion staging system tool is tethered to a string.

3. The method of claim 1, wherein the downhole completion staging system tool is translated within the wellbore using the in situ channelization treatment fluid as a transport medium.

4. The method of claim 1, wherein the downhole completion staging system tool comprises a wireline tool string comprising a blanking plug and perforating guns, and further comprising setting the blanking plug in the wellbore, placing one or more perforation clusters above the blanking plug, and recovering the wireline tool string to the surface, wherein the in situ channelization treatment fluid is circulated through the wellbore into the formation to create the fracture, place the clusters or a combination thereof.

5. The method of claim 1, wherein the downhole completion staging system tool comprises a pipe or coiled tubing string comprising a jetting assembly, and further comprising placing the jetting assembly in the wellbore, closing an annulus around the string, circulating abrasive materials down the string through the jetting assembly to perforate a wellbore casing, wherein the in situ channelization treatment fluid is circulated through the annulus, perforations and into the formation to create the fracture, place the clusters or a combination thereof.

6. The method of claim 1, further comprising placing a production liner in the wellbore wherein the production liner is fitted with a plurality of sliding sleeves in the closed position, and inserting a sleeve-shifting device into a capture feature on the downhole completion staging system tool to open a fracturing port, wherein the in situ channelization treatment fluid is circulated through the fracturing port and into the formation to create the fracture, place the clusters or a combination thereof.

7. The method of claim 1, further comprising forming a plug between at least two stages.

8. The method of claim 7, wherein the plug is formed from an in situ channelization treatment fluid and further comprising re-slurrying the plug following completion of the clusters placement for one stage to access another one of the one or more additional stages for a subsequent isolation and clusters placement for the additional one of the one or more stages.

9. The method of claim 1, wherein in situ channelization treatment fluid from one stage is circulated in the wellbore to another stage to create the fracture, place the clusters or a combination thereof.

10. The method of claim 1, further comprising circulating another in situ channelization treatment fluid through the wellbore between stages to flush debris from the wellbore following completion of one stage and prior to initiation of a serial stage, wherein the flushing slurry treatment fluid may be the same or different treatment fluid with respect to the proppant placement treatment fluid of either or both of the immediately preceding or immediately subsequent stages.

11. The method of claim 1, wherein the solid particulates and the anchorant have different shapes, sizes, densities or a combination thereof.

12. The method of claim 1, wherein the anchorant is a fiber, a flake, a ribbon, a platelet, a rod, or a combination thereof.

13. The method of claim 12, wherein the anchorant is selected from the group consisting of polylactic acid, polyester, polycaprolactam, polyamide, polyglycolic acid, polyterephthalate, cellulose, wool, basalt, glass, rubber, sticky fiber, or a combination thereof.

14. The method of claim 1, wherein after injecting the in situ channelization treatment fluid, said fluid is allowed to settle in the fracture for a period of time.

15. A method, comprising:

placing a downhole completion staging tool in a wellbore adjacent a subterranean formation;

operating the downhole completion staging tool to establish one or more passages for fluid communication between the wellbore and the subterranean formation in a plurality of wellbore stages spaced along the wellbore;

isolating one or more of the wellbore stages for treatment;

injecting an in situ channelization treatment fluid through the wellbore and the one or more passages of the isolated wellbore stage into the subterranean formation to form within a fracture a homogeneous region of continuously uniform distribution of solid particulates and thereafter aggregate the solid particulates to place clusters in the fracture;

circulating an in situ channelization treatment fluid through the isolated wellbore stage to facilitate removal of proppant from the wellbore stage; and repeating the isolation, clusters placement and slurry treatment fluid circulation for one or more additional stages wherein the in situ channelization treatment fluid comprises a carrier fluid, the solid particulates, a breaker, and at least an anchorant, the breaker inducing settling of the solid particulates prior to closure of the fracture.

16. The method of claim 15, further comprising reducing the viscosity of the in situ channelization treatment fluid after its placement.

17. The method of claim 15, wherein the viscosity reduction is enabled by a breaker.

18. A method, comprising:

placing a downhole completion staging tool in a wellbore adjacent a subterranean formation;

operating the downhole completion staging tool to establish one or more passages for fluid communication between the wellbore and the subterranean formation in a plurality of wellbore stages spaced along the wellbore;

injecting an in situ channelization treatment fluid through the wellbore and the one or more passages into the subterranean formation to form within a fracture a homogeneous region of continuously uniform distribution of solid particulates and a breaker, and thereafter aggregate the at least one solid particulates to place clusters in the fracture;

wherein the breaker induces settling of the at least one solid particulate in the fracture prior to closure of the fracture;

moving the downhole completion staging tool away from the one or more passages either before, during or after the injection without removing the downhole completion staging tool from the wellbore;

deploying a diversion agent to block further flow through the one or more passages;

circulating an in situ channelization treatment fluid through the wellbore as the injected treatment fluid or as a flush to facilitate removal of proppant from the wellbore; and repeating the downhole completion staging tool placement and operation, clusters placement, downhole completion staging tool movement and in situ channelization treatment fluid circulation for one or more additional stages.

* * * * *